US011447906B2

(12) United States Patent
Zhao et al.

(10) Patent No.: US 11,447,906 B2
(45) Date of Patent: Sep. 20, 2022

(54) LAUNDRY TREATMENT AGENT STORAGE AND DISPENSING DEVICE, WASHING MACHINE, AND LAUNDRY TREATMENT AGENT DISPENSING CONTROL METHOD OF WASHING MACHINE

(71) Applicants: CHONGQING HAIER DRUM WASHING MACHINE CO., LTD., Chongqing (CN); HAIER SMART HOME CO., LTD., Shandong (CN)

(72) Inventors: Zhiqiang Zhao, Shandong (CN); Peishi Lv, Shandong (CN); Sheng Xu, Shandong (CN); Yujing Xing, Shandong (CN); Huacheng Song, Shandong (CN)

(73) Assignees: CHONGQING HAIER DRUM WASHING MACHINE CO., LTD., Chongqing (CN); HAIER SMART HOME CO., LTD., Shandong (CN)

( * ) Notice: Subject to any disclaimer, the term of this patent is extended or adjusted under 35 U.S.C. 154(b) by 0 days.

(21) Appl. No.: 15/733,191

(22) PCT Filed: Dec. 5, 2018

(86) PCT No.: PCT/CN2018/119394

§ 371 (c)(1),
(2) Date: Jun. 8, 2020

(87) PCT Pub. No.: WO2019/109958

PCT Pub. Date: Jun. 13, 2019

(65) Prior Publication Data

US 2021/0102330 A1 Apr. 8, 2021

(30) Foreign Application Priority Data

Dec. 7, 2017 (CN) ..... 201711287291.7
Dec. 7, 2017 (CN) ..... 201711288444.X

(51) Int. Cl.
*D06F 39/02* (2006.01)
*D06F 33/37* (2020.01)
(Continued)

(52) U.S. Cl.
CPC ..... *D06F 39/022* (2013.01); *D06F 33/37* (2020.02); *D06F 39/02* (2013.01); *D06F 33/57* (2020.02);
(Continued)

(58) Field of Classification Search
CPC ..... D06F 33/37; D06F 33/57; D06F 39/02; D06F 39/022; D06F 39/028; D06F 2105/42
See application file for complete search history.

(56) References Cited

U.S. PATENT DOCUMENTS 3,162,324 A * 12/1964 Houser ..... D06F 39/022 222/18
3,223,285 A * 12/1965 Anderson ..... D06F 39/022 222/651
(Continued)

FOREIGN PATENT DOCUMENTS

CN 106884284 A 6/2017
CN 106894203 A 6/2017
(Continued)

OTHER PUBLICATIONS

International Search Report (PCT/ISA/210), with translation, and Written Opinion (PCT/ISA/237) dated Feb. 27, 2019, by the Chinese Patent Office as the International Searching Authority for International Application No. PCT/CN2018/119394.
(Continued)

*Primary Examiner* — Joseph L. Perrin
(74) *Attorney, Agent, or Firm* — Buchanan Ingersoll & Rooney PC

(57) ABSTRACT

A laundry treatment agent storage and dispensing device comprises a storage device and a dispensing device which
(Continued)

are integrally arranged. A storage cavity or box stores laundry treatment agent. The dispensing device has a hollow cavity, and a flexible separator is hermetically installed in the hollow cavity to divide the hollow cavity into a water inlet cavity and a liquid storage cavity. The liquid storage cavity has a liquid inlet end and a liquid outlet end; the liquid inlet end communicates with the storage cavity or box. Inlet water of the washing machine flows into/out of the water inlet cavity, the flexible separator is squeezed to deform towards the liquid storage cavity to enable the laundry treatment agent accommodated in the liquid storage cavity to be discharged through the liquid outlet end. The laundry treatment agent is stored and automatically dispensed by the storage device and the dispensing device.

6 Claims, 8 Drawing Sheets

(51) Int. Cl.
*D06F 105/42* (2020.01)
*D06F 33/57* (2020.01)

(52) U.S. Cl.
CPC ..... *D06F 39/028* (2013.01); *D06F 2105/42* (2020.02)

(56) References Cited

U.S. PATENT DOCUMENTS 4,199,535 A * 4/1980 Kuhlen ..... F02M 7/08 261/34.2
2007/0125134 A1 6/2007 Park

FOREIGN PATENT DOCUMENTS

| | | | | |
|---|---|---|---|---|
| CN | 107299491 A | | 10/2017 | |
| CN | 206591316 U | | 10/2017 | |
| DE | 102008038476 B3 | | 8/2009 | |
| GB | 1383646 A | * | 2/1974 | ..... F04B 43/06 |
| JP | 2002128198 A | | 5/2002 | |

OTHER PUBLICATIONS

European Search Opinion dated Nov. 25, 2020, issued in corresponding European Application No. 18886524.0. (4 pages).

* cited by examiner

A–A

LAUNDRY TREATMENT AGENT STORAGE AND DISPENSING DEVICE, WASHING MACHINE, AND LAUNDRY TREATMENT AGENT DISPENSING CONTROL METHOD OF WASHING MACHINE

TECHNICAL FIELD

The present disclosure relates to the technical field of automatic dispensing of laundry treatment agent of washing machine, in particular to a laundry treatment agent storage and dispensing device, a washing machine and a laundry treatment agent dispensing control method of the washing machine.

BACKGROUND

Washing machines are the most commonly used household appliances in people daily lives, with the continuous development and progress of technology, on the basis of meeting the basic laundry washing requirements of people, the research and development of washing machines are increasingly focusing on improving the user experience. More and more washing machines have an automatic detergent dispensing function, so that users no longer need to manually add detergents when using washing machines for laundry washing, usage by users is greatly facilitated, and the user experience is improved.

Detergent dispensing methods of existing automatic washing machines generally adopt the Venturi principle for dispensing, change in the diameter of a water inlet pipe causes pressure change, a certain negative pressure can be formed, and detergents are sucked into the water inlet pipe and driven by the inlet water to be input into an outer washing tub of a washing machine uniformly. This automatic detergent dispensing method has certain requirements on the design and assembly of structures, and the structures are relatively complicated to implement, and the cost is relatively high. In addition, some washing machines input detergents through motor-drive gear pumps, peristaltic pumps and piston pumps, this manner requires additional motors and pumps, the cost is high, and precise quantitative dispensing cannot be achieved.

In view of this, to solve the problems that automatic detergent dispensing by existing washing machines is not accurate enough and poor in effect of dispensing multiple detergents, the present disclosure provides a multifunctional detergent automatic dispensing washing machine, specifically an automatic dispensing system which is optimized in principle and more convenient and feasible and can accurately and quantitatively input various detergents and care agents with different functions.

SUMMARY

In order to solve the above problems, the first object of the present disclosure is to provide a laundry treatment agent storage and dispensing device, specifically, the adopted technical solutions are as follows.

A laundry treatment agent storage and dispensing device, comprises a storage device and a dispensing device which are integrally arranged. The storage device is internally provided with a storage cavity or a storage box, and the storage cavity or storage box is configured to be storing laundry treatment agent. The dispensing device is provided with a hollow cavity, and a flexible separator is hermetically installed in the hollow cavity to divide the hollow cavity into a water inlet cavity and a liquid storage cavity. The liquid storage cavity is provided with a liquid inlet end and a liquid outlet end; the liquid inlet end is communicated with the storage cavity or storage box. Inlet water of a washing machine flowing into/out of the water inlet cavity, the flexible separator is squeezed to deform to enable the laundry treatment agent accommodated in the liquid storage cavity to be discharged through the liquid outlet end.

Further, the storage device comprises a storage housing internally provided with the storage cavity, a filling port communicated with the storage cavity is provided in the storage housing. The dispensing device is integrally arranged on the storage housing.

Further, the storage housing is internally provided with a liquid outlet flow channel communicated with the storage cavity, and the liquid inlet end of the dispensing device is communicated with the liquid outlet flow channel.

Further, the storage housing is hollow internally, a partition plate is arranged in the storage housing, and the interior of the storage housing is divided into the storage cavity and the liquid outlet flow channel which are communicated with each other via the partition plate.

Preferably, the partition plate extends from a top wall to a bottom wall of the storage housing is spaced apart from the bottom wall to form the storage cavity and the liquid outlet flow channel communicated with each other.

Further, the dispensing device comprises a housing internally provided with the hollow cavity, and the housing and the storage housing are integrally arranged.

Further, the housing comprises a first housing and a second housing, at least one of the first housing and the second housing is internally provided with an open groove, and the first housing and the second housing are hermetically connected to seal the open groove to form the hollow cavity. An edge of the flexible separator is hermetically pressed between the first housing and the second housing to divide the hollow cavity into the water inlet cavity and the liquid storage cavity. A water inlet end and a pressure relief end which are communicated with the water inlet cavity are provided on the first housing, and the liquid inlet end and the liquid outlet end which are communicated with the liquid storage cavity are provided on the second housing. The second housing and the storage housing are integrally arranged.

Further, the liquid inlet end and the liquid outlet end are respectively provided with a one-way communicating device. The flexible separator is deformed towards the liquid storage cavity by inlet water of the washing machine, the one-way communicating device in the liquid outlet end is opened to dispense laundry treatment agent. The flexible separator is restored from deformation when the washing machine stops feeding water, the one-way communicating device in the liquid inlet end is opened to suck the laundry treatment agent in the storage cavity into the liquid storage cavity.

Further, the housing of the dispensing device is internally provided with at least two hollow cavities, and the flexible separator is hermetically installed in each of the hollow cavities for dividing each of the hollow cavities into the water inlet cavity and the liquid storage cavity. The water inlet end and the pressure relief end which are communicated with the water inlet cavity are arranged at a part, corresponding to each of the hollow cavities, of the housing. The liquid inlet end and the liquid outlet end which are communicated with the liquid storage cavity are arranged at the part, corresponding to each of the hollow cavities, of the housing. The storage housing of the storage device is internally provided with a plurality of storage cavities corresponding to each of the hollow cavities of the dispensing device. The storage housing of the storage device is provided with a plurality of filling ports communicated with each of the storage cavities. Each of the storage cavities is communicated with the liquid storage cavities of the hollow cavities correspondingly.

Further, the housing is internally provided with a first hollow cavity and a second hollow cavity which are separated from each other. A first flexible separator is hermetically installed in the first hollow cavity for dividing the first hollow cavity into a first water inlet cavity and a first liquid storage cavity, and a second flexible separator is hermetically installed in the second hollow cavity for dividing the second hollow cavity into a second water inlet cavity and a second liquid storage cavity. The storage housing of the storage device is internally provided with a first storage cavity and a second storage cavity, the first storage cavity is configured to be accommodating detergent, and the second storage cavity is configured to be accommodating softener. The storage housing is internally provided with a first liquid outlet flow channel communicated with the first storage cavity, and a second liquid outlet flow channel communicated with the second storage cavity. A first filling port communicated with the first storage cavity and a second filling port communicated with the second storage cavity are provided on the storage housing.

Further, the storage device comprises a storage housing internally provided with a storage cavity, the storage box is arranged in the storage cavity in the storage housing, and the dispensing device is integrally arranged on the storage housing.

Further, the storage housing is internally provided with a liquid outlet flow channel communicated with the storage cavity, and the liquid inlet end of the dispensing device is communicated with the liquid outlet flow channel.

Preferably, the storage housing is hollow internally, and a partition plate is arranged in the storage housing, and an interior of the storage housing is divided into the storage cavity and the liquid outlet flow channel communicated with each other via the partition plate.

Further, the storage box is installed in the storage cavity of the storage housing in a drawable manner, the storage box is provided with a storage liquid outlet end, and a one-way valve is installed on the storage liquid outlet end. A column is arranged in the liquid outlet flow channel, and one end of the column extends into the storage cavity. When the storage box is pushed into the storage cavity of the storage housing, the one-way valve is crashed to be open by the column; the storage box is communicated with the liquid outlet flow channel, and the laundry treatment agents in the storage box flow into the liquid outlet flow channel.

Further, the dispensing device comprises a housing internally provided with the hollow cavity, and the housing and the storage housing are integrally arranged.

Further, the housing comprises a first housing and a second housing, at least one of the first housing and the second housing is internally provided with an open groove. The first housing and the second housing are hermetically connected to seal the open groove to form the hollow cavity. An edge of the flexible separator is hermetically pressed between the first housing and the second housing for dividing the hollow cavity into the water inlet cavity and the liquid storage cavity. A water inlet end and a pressure relief end which are communicated with the water inlet cavity are provided on the first housing, and a liquid inlet end and a liquid outlet end which are communicated with the liquid storage cavity are provided on the second housing. The second housing and the storage housing are integrally arranged.

Further, the liquid inlet end and the liquid outlet end are respectively provided with a one-way communicating device. The flexible separator is deformed towards the liquid storage cavity by inlet water of the washing machine, the one-way communicating device in the liquid outlet end is opened to dispense laundry treatment agent. The flexible separator is restored from deformation when the washing machine stops feeding water, the one-way communicating device in the liquid inlet end is opened to suck the laundry treatment agent in the storage cavity into the liquid storage cavity.

Further, the housing of the dispensing device is internally provided with at least two hollow cavities, and the flexible separator is hermetically installed in each of the hollow cavities for dividing each of the hollow cavities into the water inlet cavity and the liquid storage cavity. The water inlet end and pressure relief end which are communicated with the water inlet cavity are arranged at a part, corresponding to each of the hollow cavities, of the housing. The Liquid inlet end and the liquid outlet end which are communicated with the liquid storage cavity are arranged at the part, corresponding to each of the hollow cavities, of the housing. The storage housing of the storage device is internally provided with a plurality of storage cavities corresponding to each of the hollow cavities of the dispensing device. The storage housing of the storage device is provided with a plurality of filling ports communicating with each of the storage cavities, and each of the storage cavities is communicated with the liquid storage cavities of the hollow cavities correspondingly.

Further, the housing is internally provided with a first hollow cavity and a second hollow cavity which are separated from each other. A first flexible separator is hermetically installed in the first hollow cavity for dividing the first hollow cavity into a first water inlet cavity and a first liquid storage cavity. A second flexible separator is hermetically installed in the second hollow cavity for dividing the second hollow cavity into a second water inlet cavity and a second liquid storage cavity. The storage housing of the storage device is internally provided with a first storage cavity and a second storage cavity, the first storage cavity is configured to be accommodating detergent, and the second storage cavity is configured to be accommodating softener. The storage housing is internally provided with a first liquid outlet flow channel communicated with the first storage cavity, and a second liquid outlet flow channel communicated with the second storage cavity. A first filling port communicated with the first storage cavity and a second filling port communicated with the second storage cavity are provided on the storage housing.

A second object of the present disclosure is to provide a washing machine provided with the laundry treatment agent storage and dispensing device as described in any one of the above description, specifically, the adopted technical solutions are as follows:

a washing machine provided with the laundry treatment agent storage and dispensing device as described in any one of the above description comprises a water inlet valve and a water collection box. The water inlet valve comprises a first water outlet control end communicated with the water collection box, and a second water outlet control end communicated with the water inlet cavity of the dispensing device. A pressure relief end and the liquid outlet end of the dispensing device are communicated with the water collection box respectively.

The third object of the present disclosure is to provide a laundry treatment agent dispensing control method of a washing machine. Specifically, the adopted technical solutions are as follows.

A laundry treatment agent dispensing control method of the washing machine comprises:

determining, by the washing machine, the dispensing number of times N of the dispensing device according to the total dispensing amount M of laundry treatment agents, the single quantitative dispensing amount m of the dispensing device, and the water inlet velocity V of inlet water of the washing machine, and controls the opening-closing number of times of a water inlet control device according to the dispensing number of times.

Further, when the water inlet velocity V is greater than or equal to V0, the single quantitative dispensing amount m of the dispensing device is equal to m0, wherein m0 is the dispensing amount of the laundry treatment agents by the dispensing device during single complete dispensing, and then the dispensing number of times N0=M/m0.

When the water inlet velocity V is lower than V0, the single quantitative dispensing amount m of the dispensing device is equal to A+B*V, wherein A and B are correction coefficients, and then the dispensing number of times N'=M/(A+B*V); and V0 is the minimum water inlet velocity value for the dispensing device to realize single complete dispensing of the laundry treatment agents.

Further, when the water inlet pressure P is higher than a set value P0, the water inlet velocity V is greater than or equal to V0, and when the water inlet pressure P is lower than the set value P0, the water inlet velocity V is smaller than V0, wherein P0 is the minimum water pressure value for reaching the water inlet velocity V0.

Preferably, P0 ranges from 0.05 MPa to 0.1 MPa;

Further preferably, P0=0.05 MPa.

Further, the washing machine starts a washing procedure, weighs laundry to determine the total required dispensing amount M of laundry treatment agents, and calculates the initial dispensing number of times N0=M/m0; the washing machine starts to inlet water, detects and determines the water inlet velocity V, when V is greater than or equal to V0, the washing machine controls to complete laundry treatment agent dispensing for N0 times, when V is lower than V0, then the washing machine corrects the dispensing number of times N'=M/(A+B*V), and the washing machine controls to dispense the agents according to the corrected number of times.

The water inlet velocity V of the washing machine is calculated by a water level detection device and a passage of the water inlet control device by timing;

Or, a flow sensor for measuring the water inlet velocity V is arranged on a water inlet pipe of the washing machine.

Further, the water inlet control device is a water inlet solenoid valve. Single dispersion of the laundry treatment agents can be realized by the washing machine through controlling the water inlet solenoid valve to be opened from a closed state, and the washing machine controls the water inlet solenoid valve to be closed-opened for N times according to the calculated dispensing number of times N.

Further, after the washing machine controls the water inlet solenoid valve to be closed-opened for (N−1) times during the water inlet process, the washing machine controls the water inlet solenoid valve to be opened for the Nth time, remain opened until the inlet water reaches a set water level and then be closed.

Further, the dispensing device at least comprises a first dispensing device for dispensing detergents and a second dispensing device for dispensing softeners, the storage device at least comprises a first storage device for storing the detergents and a second storage device for storing the softeners, and the water inlet control device comprises a first water inlet control device for feeding water into the first dispensing device and a second water inlet control device for feeding water into the second dispensing device;

During a water inlet process of the washing procedure, the washing machine determines the dispensing number of times of the detergents, and controls the first water inlet control device to be closed-opened for corresponding times; and During a water inlet process of the last rinsing procedure, the washing machine determines the dispensing number of times of the softeners, and controls the second water inlet control device to be closed-opened for corresponding times.

Further, the water inlet velocity V is obtained during the water inlet process of the washing procedure of the washing machine, and is used to calculate the dispensing number of times of the softeners during the water inlet process of the last rinsing procedure.

Further, the method comprises:

S1, starting the washing machine;

S2, weighing, by the washing machine, laundry to determine the required amount M of laundry treatment agents, and calculating the initial dispensing number of times N0=M/m0;

S3, obtaining, by the washing machine, the water inlet velocity V and judging whether the water inlet velocity V is greater than or equal to V0; and S4, controlling the water inlet control devices to be opened-closed for (N0−1) times if yes, keeping the water inlet control devices opened when the water inlet control devices are closed-opened for the N0th time until inlet water reaches a set water level, and then closing the water inlet control devices; and correcting the dispensing number of times N' to be equal to M/(A+B*V) if no, controlling the water inlet control devices to be opened-closed for (N'−1) times, keeping the water inlet control devices opened when the water inlet control devices are closed-opened for the N'th time until inlet water reaches a set water level, and then closing the water inlet control devices.

Further, the control method comprising:

determining, by the washing machine, the dispensing number of times N of the dispensing device, and controlling, by the washing machine, the water inlet control devices to be closed/opened for N times in total during the main water inlet process and after the main inlet water reaches the set water level.

Further, after the washing machine completes the main water inlet process, if the water refilling process is performed, the washing machine controls the water inlet control devices to be closed/opened for N times in total during the main water inlet process, during the water refilling process and after the water refilling process is completed.

Further, if the washing machine performs the water refilling process, the washing machine controls the water inlet control devices to be closed/opened for N1 times during the main water inlet process, to be closed/opened for N2 times during the water refilling process and to be closed/opened for N3 times after the water refilling process is completed, wherein N1+N2<=N, and N2 is not smaller than the maximum number of times in the water refilling process of the washing machine.

Further, water inlet of the washing machine comprises the main water inlet process, the washing machine controls the water inlet control devices to be closed/opened for N1 times during the main water inlet process, wherein N>N1, whether the water refilling process needs to be performed is judged after the main water inlet process is completed, if yes, the washing machine controls the water inlet control devices to be closed/opened for (N−N1) times during the water refilling process and after the water refilling process is completed; if no, the washing machine controls the water inlet control devices to be closed/opened for (N−N1) times.

Further, if the washing machine performs the water refilling process, the washing machine controls the water inlet control devices to be closed/opened for N2 times, wherein N2<=(N−N1), and after the water refilling process is completed, the washing machine controls the water inlet control devices to be closed/opened for (N−N1−N2) times.

Further, if the washing machine performs the water refilling process for x times, then the washing machine controls the water inlet control device to be closed/opened for N21 times during the first water refilling process, to be closed/opened for N22 times during the second water refilling process . . . and to be closed/opened for N2x times during the xth water refilling process, wherein N21+N22+ . . . +N2x=N2, and N21, N22, . . . , N2x are greater than or equal to 1.

Further, after the washing machine performs the main water inlet process and controls the water inlet control devices to be closed/opened for N1−1 times, the washing machine controls the water inlet control devices to be opened for the N1th time, remain opened and then be closed until inlet water reaches the set water level, and then the main water inlet process is completed.

Further, after the main water inlet process is completed and the washing machine controls an inner tub to rotate for a set time t, it is detected whether the water level reaches the set water level, if yes, the washing machine controls the water inlet control devices to be closed/opened for N−N1 times so as to complete dispensing of the laundry treatment agents, and if no, the washing machine performs the water refilling process.

Further, the washing machine determines the dispensing number of times N=M/m of the dispensing device according to the total dispensing amount M of the laundry treatment agents and the single quantitative dispensing amount m of the dispensing device, and controls the opening-closing number of times of the water inlet control devices according to the dispensing number of times.

Further, the washing machine determines the dispensing number of times N of the dispensing device according to the total dispensing amount M of the laundry treatment agents, the single quantitative dispensing amount m of the dispensing device, and the water inlet velocity V of inlet water of the washing machine, and controls the opening-closing number of times of the water inlet control devices according to the dispensing number of times.

When the water inlet velocity V is greater than or equal to V0, the single quantitative dispensing amount m of the dispensing device is equal to m0, wherein m0 is the dispensing amount of the laundry treatment agents by the dispensing device during single complete dispensing, and then the dispensing number of times N0=M/m0;

When the water inlet velocity V is lower than V0, the single quantitative dispensing amount m of the dispensing device is equal to A+B*V, wherein A and B are correction coefficients, and then the dispensing number of times N'=M/(A+B*V); and V0 is the minimum water inlet velocity value for the dispensing device to realize single complete dispensing of the laundry treatment agents.

According to the laundry treatment agent storage and dispensing device of the present disclosure, the laundry treatment agents are stored by the storage device, the laundry treatment agents in the storage device are automatically dispensing by the dispensing device, and the storage device and the dispensing device are integrally arranged, the liquid inlet end can communicate with the storage box by integrating a flow channel in the storage device, complicated pipeline communication between the dispensing device and the storage device is simplified, the structure is simpler, and assembly is more convenient due to the integrated design.

The dispensing device of the present disclosure adopts a principle different from an existing automatic dispensing principle, inlet water of the washing machine is used for squeezing the flexible separators to deform towards the liquid storage cavities for "ejecting" the laundry treatment agents in the liquid storage cavities, so that the automatic dispensing of the laundry treatment agents is realized. The dispensing device of the present disclosure can dispense agents just by controlling inlet water of the washing machine, the automatic dispensing principle is changed, the structural design is more optimal, and the production cost is lower.

Furthermore, the amount of the laundry treatment agents accommodated in the liquid storage cavities of the hollow cavities of the dispensing device is fixed, all the laundry treatment agents are "ejected" during each time of dispensing, thus, the volume of the hollow cavities can be designed or the dispensing number of times can be controlled according to the demand for the laundry treatment agents, the dispensing amount of the laundry treatment agents is more accurate, and the laundry washing effect is improved.

In addition, the laundry treatment agents of the present disclosure include but are not limited to detergents; softeners, disinfectants, laundry care agents and fragrances, and the dispensing amount and dispensing time of various laundry treatment agents are different. The dispensing device of the present disclosure can be provided with multiple hollow cavities for different laundry treatment agents, the liquid storage cavities of all the hollow cavities can store various laundry treatment agents, and inlet water is controlled to enter the corresponding hollow cavities at the corresponding time to meet the dispensing requirements on the various laundry treatment agents.

Therefore, the laundry treatment agent dispensing device of the present disclosure can ensure that there are no residues in the process of dispensing the various detergents and care agents, the problem of mutual contamination of various detergents and care agents is avoided, and the laundry washing effect is effectively improved.

The agent dispensing device of the present disclosure adopts a principle different from an existing automatic dispensing principle, inlet water of the washing machine is used for squeezing the flexible separators to deform towards the liquid storage cavities for "ejecting" the laundry treatment agents in the liquid storage cavities, so that the automatic dispensing of the laundry treatment agents is realized.

The dispensing device of the present disclosure can dispense agents just by controlling inlet water of the washing machine, the automatic dispensing principle is changed, the structural design is more optimal, and the production cost is lower.

Furthermore, the amount of the laundry treatment agents accommodated in the liquid storage cavities of the hollow cavities is fixed, all the laundry treatment agents are "ejected" during each time of dispensing, thus, the volume of the hollow cavities can be designed or the dispensing number of times can be controlled according to the demand for the laundry treatment agents, the dispensing amount of the laundry treatment agents is more accurate, and the laundry washing effect is improved.

In addition, the laundry treatment agents of the present disclosure include but are not limited to detergents; softeners, disinfectants, laundry care agents and fragrances, and the dispensing amount and dispensing time of various laundry treatment agents are different. The dispensing device of the present disclosure may be provided with multiple hollow cavities for different laundry treatment agents, the liquid storage cavities of all the hollow cavities can store various laundry treatment agents, and inlet water is controlled to enter the corresponding hollow cavities at the corresponding time to meet the dispensing requirements on the various laundry treatment agents.

The laundry treatment agent dispensing device of the present disclosure can ensure that there are no residues in the process of feeding the various detergents and care agents, the problem of mutual contamination of various detergents and care agent require different amounts of laundry treatment agents, therefore, in the specific washing process, the dispensing number of times of the dispensing device needs to be determined according to the required dispensing amount of the laundry treatment agents during each time of washing.

The influence of the water inlet velocity on the single dispensing amount is fully considered according to the dispensing principle of the dispensing device of the present disclosure, and the dispensing accuracy of the laundry treatment agents is improved.

The process of dispensing laundry by the dispensing device of the present disclosure generally comprises: the washing machine determines the total dispensing amount at first and determines the dispensing number of times N according to the total dispensing amount and each-time dispensing amount of the dispensing device, the washing machine controls the water inlet control device to be closed-opened for the dispensing device to carry out dispensing for the determined times, after performing the N−1th dispensing action, the water inlet control device remains opened at the Nth action until the set water level is reached, and accurate dispensing of the laundry treatment agents is achieved while water inlet realized.

However, in a drum washing machine, the total water volume is low and laundry are water-absorbent, after inlet water reaches the preset water level and after the drum rotates and laundry absorbs water, the water level is judged, once the water level is lower than the preset water level, the water inlet control devices need to be opened to continue water refilling. For the dispensing mode, if the washing machine is refilled with water, the dispensing amount is high, and dispensing errors are caused.

Therefore, according to the laundry treatment agent automatic dispensing method of the washing machine of the present disclosure, laundry treatment agents are not dispensing for N times during the main water inlet process, some of the laundry treatment agents remain for dispensing during the subsequent refilling process, or the laundry treatment agents can be rapidly dispensing for the returns to the original position times after the main water inlet process is completed even if water refilling is not conducted, the water inlet volume slightly increases but is negligible, while accurate dispensing at the dispensing amount is achieved.

DETAILED DESCRIPTION

A laundry treatment agent storage and dispensing device, a washing machine and a laundry treatment agent dispensing control method according to the present disclosure will be detailed below in conjunction with the drawings:

Embodiment 1

Figure 1:
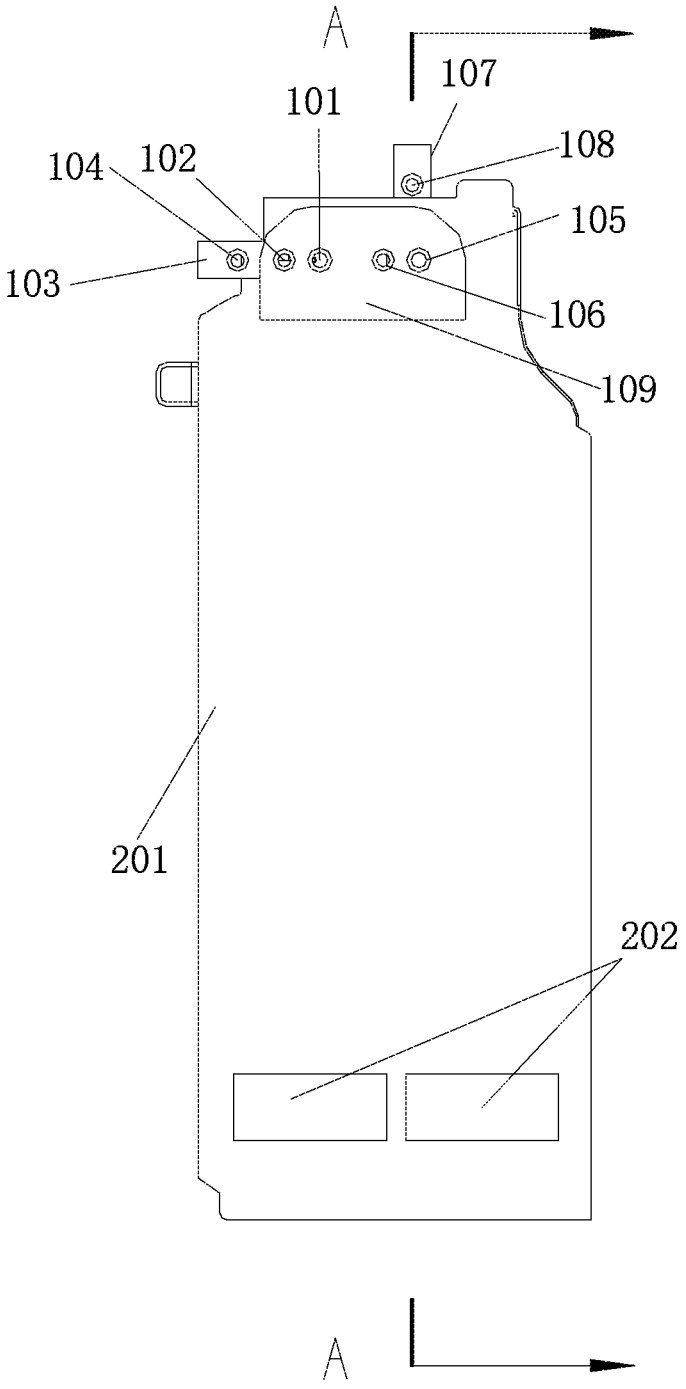
FIG. 1 is a top view of a laundry treatment agent storage and dispensing device according to Embodiments 1, 3, 4 and 5 of the present disclosure.
Figure 2:
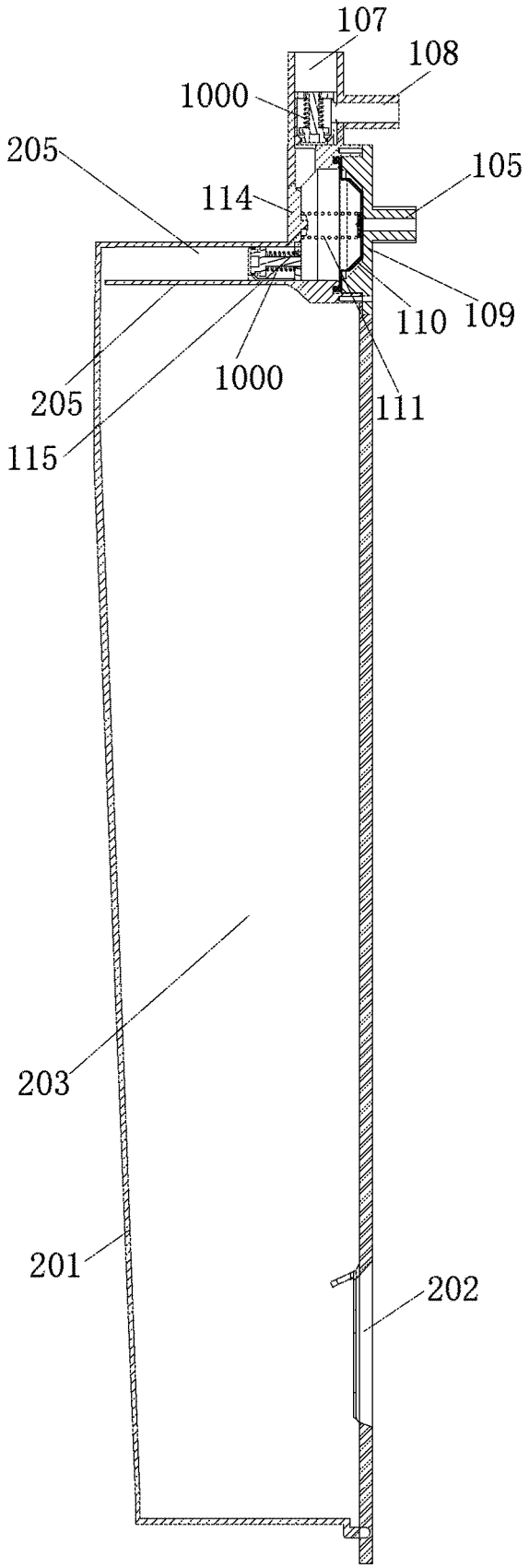
FIG. 2 is a cross-sectional view along the A-A surface in FIG. 1 of a laundry treatment agent storage and dispensing device according to Embodiments 1, 3, 4 and 5 of the present disclosure.
Figure 3:
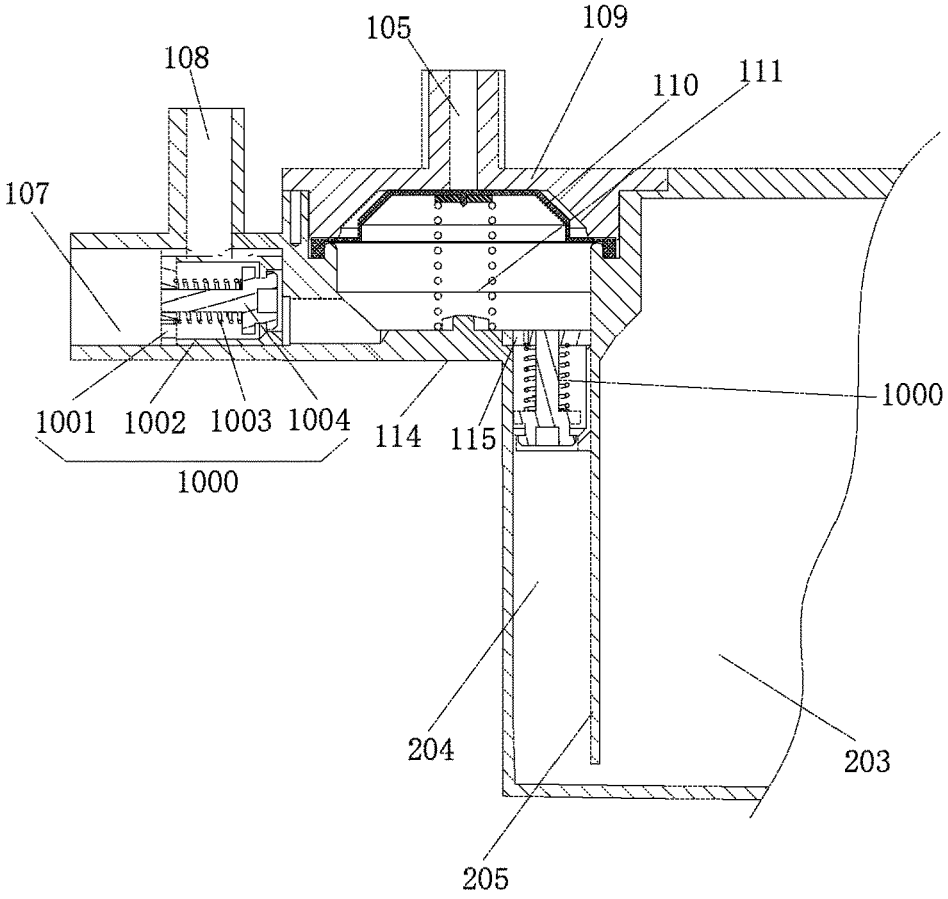
FIG. 3 is a partial enlarged view of FIG. 2 of a laundry treatment agent storage and dispensing device according to Embodiments 1, 3, 4 and 5 of the present disclosure.
Figure 4:
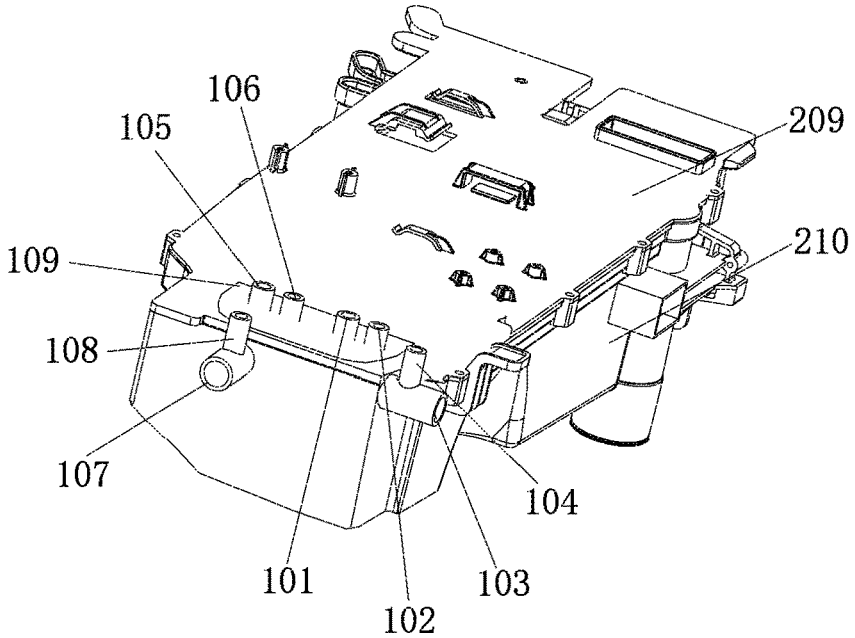
FIG. 4 is a schematic diagram of a three-dimensional structure of a laundry treatment agent storage and dispensing device according to Embodiments 2 to 5 of the present disclosure.
Figure 5:
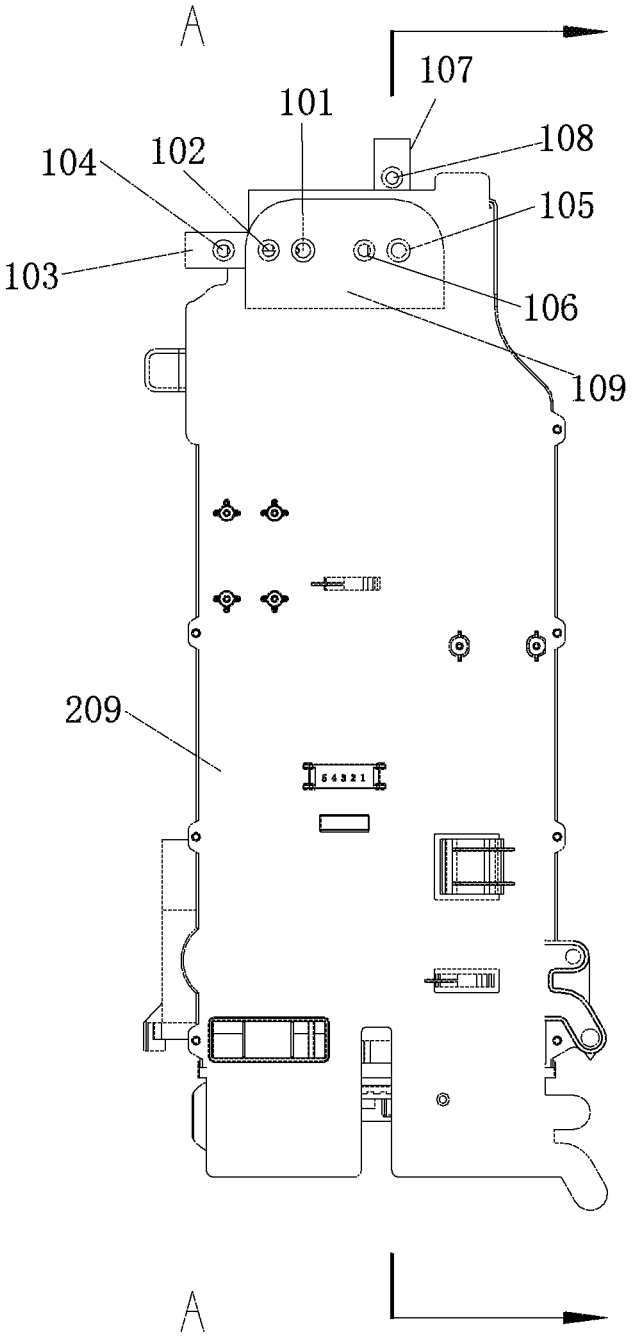
FIG. 5 is a top view of a laundry treatment agent storage and dispensing device according to Embodiments 2 to 5 of the present disclosure.
Figure 6:
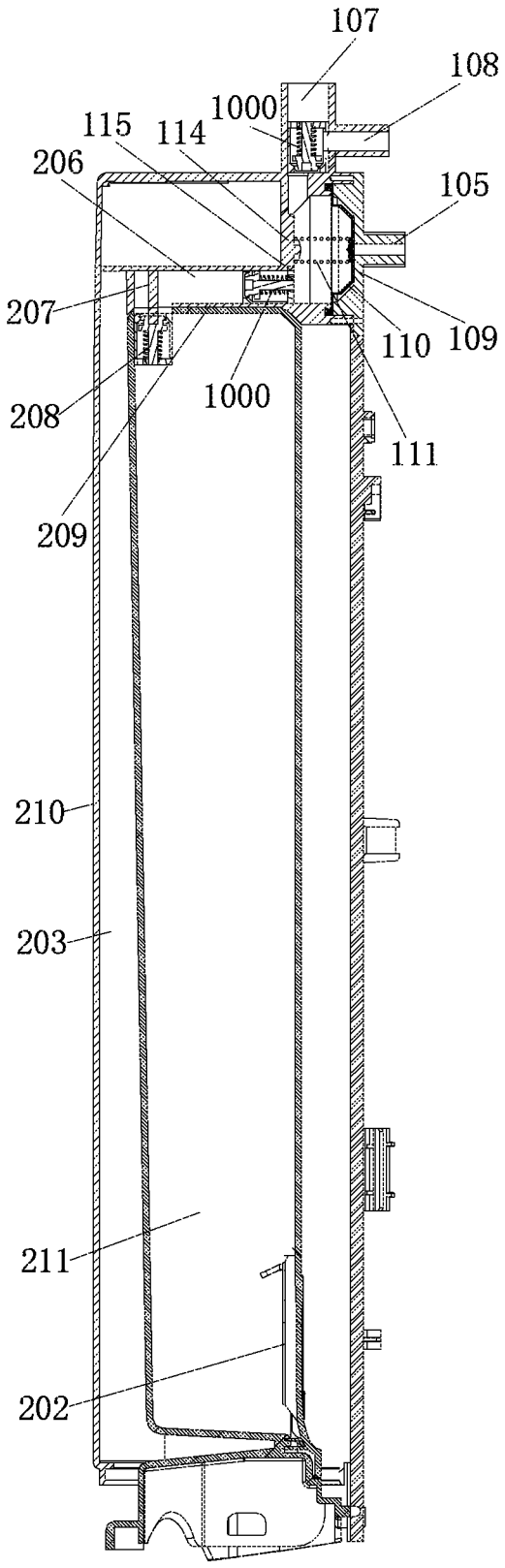
FIG. 6 is a cross-sectional view along the A-A surface in FIG. 2 of a laundry treatment agent storage and dispensing device according to Embodiments 2 to 5 of the present disclosure.

As shown in FIGS. 1-3, a laundry treatment agent storage and dispensing device according to the embodiment comprises a storage device and a dispensing device which are integrally arranged. The storage device is internally provided with a storage cavity 203, and the storage cavity 203 is configured to be storing laundry treatment agent. The dispensing device is provided with a hollow cavity, and a flexible separator 110 is hermetically installed in the hollow cavity for dividing the hollow cavity into a water inlet cavity and a liquid storage cavity. The liquid storage cavity is provided with a liquid inlet end 115 and a liquid outlet end, and the liquid inlet end 115 is communicated with the storage cavity 203. Inlet water of a washing machine flowing into/out of the water inlet cavity, the flexible separator is squeezed to deform to enable the laundry treatment agent accommodated in the liquid storage cavity to be discharged through the liquid outlet end.

According to the laundry treatment agent storage and dispensing device of the embodiment, the laundry treatment agent is stored in the storage device; the laundry treatment agent in the storage device is automatically dispensed by the dispensing device. The storage device and the dispensing device are integrally arranged. The liquid inlet end 115 can communicate with the storage cavity 203 by integrating a flow channel in the storage device, so that complicated pipeline communication between the dispensing device and the storage device is simplified, the structure is simpler, and assembly is more convenient due to the integrated design.

Further, the storage device described in the embodiment comprises a storage housing 201 internally provided with a storage cavity. A filling port 202 communicated with the storage cavity is provided in the storage housing 201. The dispensing device is integrally arranged on the storage housing 201.

In order to realize communication of the liquid storage cavity of the dispensing device with the storage cavity of the storage device, the storage housing 201 described in the embodiment is internally provided with a liquid outlet flow channel 204 communicated with the storage cavity 203. The liquid inlet end 115 of the dispensing device is communicated with the liquid outlet flow channel 204. According to the embodiment, the liquid outlet flow channel 204 communicated with the storage cavity 203 is designed by virtue of the internal cavity of the storage housing 201, then the dispensing device is integrally arranged on the storage housing 201. When the liquid inlet end is communicated with the liquid outlet flow channel 204, communication of the dispensing device with the storage device can be realized, so that the pipeline connection is simplified, the structure is simple, and assembly is convenient.

Specifically, the storage housing 201 described in the embodiment is hollow internally, and the storage housing 201 is internally provided with a partition plate 205. The interior of the storage housing 201 is divided into the storage cavity 203 and the liquid outlet flow channel 204 which are communicated with each other via the partition plate 205.

Preferably, the partition plate 205 extends from a top wall to a bottom wall of the storage housing 201. An interval is formed between the partition plate and the bottom wall, so that the storage cavity 203 and the liquid outlet flow channel 204 can be communicated with each other. The liquid inlet end 115 of the dispensing device of the embodiment is arranged at a bottom of a housing of the dispensing device and is communicated with a top portion of the liquid outlet flow channel 204.

As a preferred mode of the embodiment, the dispensing device comprises the housing internally provided with the hollow cavity, and the housing and the storage housing 201 are integrally arranged.

Further, the housing comprises a first housing 109 and a second housing 114, the first housing 109 and/or the second housing 114 are/is internally provided with open grooves. The first housing 109 and the second housing 114 are connected in a sealed manner so as to seal the open grooves to form the hollow cavity. The edge of the flexible separator 110 is hermetically pressed between the first housing 109 and the second housing 114 to divide the hollow cavity into the water inlet cavity and the liquid storage cavity. The first housing 109 is provided with water inlet ends (101 and 105) and pressure relief ends (102 and 106) which are communicated with the water inlet cavity. The second housing 114 is provided with liquid inlet ends 115 and liquid outlet ends (103 and 107) which are communicated with the liquid storage cavity. The second housing 114 and the storage housing 201 are integrally arranged. The housing of the dispensing device of the embodiment comprises the first housing 109 and the second housing 114 which are detachably and fixedly connected.

The liquid inlet ends 115 and the liquid outlet ends (103 and 107) of the dispensing device of the embodiment are respectively provided with a one-way communicating device 1000 correspondingly. Inlet water of the washing machine squeezes the flexible separator to deform towards the liquid storage cavity; the one-way communicating devices in the liquid outlet ends (103 and 107) are opened to dispense the laundry treatment agents. The washing machine stops water inlet, the flexible separator is restored from deformation, and the one-way communicating devices in the liquid inlet ends 115 are opened to suck the laundry treatment agents in the storage cavity 203 into the liquid storage cavity.

As an implementation of the embodiment, the housing of the dispensing device is internally provided with at least two hollow cavities, the flexible separator 110 is installed in each of the hollow cavities in a sealed manner so as to divide each of the hollow cavities into the water inlet cavity and the liquid storage cavity.

The water inlet end and the pressure relief end which are communicated with the water inlet cavity are arranged at a part, corresponding to each of the hollow cavities, of the housing. The liquid inlet end and the liquid outlet end which are communicated with the liquid storage cavity are arranged at a part, corresponding to each of the hollow cavities, of the housing.

The storage housing of the storage device is internally provided with a plurality of storage cavities corresponding to each of the hollow cavities of the dispensing device. The storage housing of the storage device is provided with a plurality of filling ports communicated with each of the storage cavities. Each of the storage cavities is communicated with the liquid storage cavities of the hollow cavities correspondingly. The laundry treatment agent storage and dispensing device of the embodiment can store various laundry treatment agents, such as detergents, softeners, disinfectants and laundry care agents, and each of the laundry treatment agents can be dispensed by controlling inlet water of the washing machine to enter the corresponding hollow cavities of the dispensing device.

Specifically, when it is required to dispense the most commonly used detergent and softener, the housing is internally provided with a first hollow cavity and a second hollow cavity which are separated from each other. A first flexible separator is hermetically installed in the first hollow cavity to divide the first hollow cavity into a first water inlet cavity and a first liquid storage cavity. A second flexible separator is hermetically installed in the second hollow cavity to divide the second hollow cavity into a second water inlet cavity and a second liquid storage cavity. The housing of the dispensing device is provided with a first water inlet end 101 and a first pressure relief end 102 which are communicated with the first water inlet cavity of the first hollow cavity, and a first liquid inlet end and a first liquid outlet end 103 which are communicated with the first liquid storage cavity. The housing of the dispensing device is provided with a second water inlet end 105 and a second pressure relief end 106 which are communicated with the second water inlet cavity of the second hollow cavity, and a second liquid inlet end and a second liquid outlet end 107 which are communicated with the second liquid storage cavity.

The storage housing of the storage device is internally provided with a first storage cavity and a second storage cavity. The first storage cavity is configured to be accommodating detergent, and the second storage cavity is configured to be accommodating softener.

The storage housing is further internally provided with a first liquid outlet flow channel communicated with the first storage cavity, and a second liquid outlet flow channel communicated with the second storage cavity. A first filling port communicated with the first storage cavity and a second filling port communicated with the second storage cavity are provided in the storage housing correspondingly.

The filling ports of the embodiment are used for inputting the laundry treatment agents to the storage cavities 203.

The storage housing of the embodiment comprises a housing body with an open cavity and a housing cover body which covers an opening of the housing body. The partition plate 205 is arranged on the housing cover body and extends towards a bottom wall of the housing body. In the embodiment, the filling port 202 is arranged at one end of the housing cover body, the partition plate is arranged at another end opposite to the filling ports. The second housing 114 of the dispensing device is integrally formed by the end, opposite to the filling ports, of the housing body.

Embodiment 2

As shown in FIGS. 4-7, the laundry treatment agent storage and dispensing device of the embodiment comprises a storage device and a dispensing device which are integrally arranged. The storage device comprises a storage box 204 configured to be storing laundry treatment agent. The dispensing device is provided with a hollow cavity, and a flexible separator 110 is hermetically installed in the hollow cavity to divide the hollow cavity into a water inlet cavity and a liquid storage cavity. The liquid storage cavity is provided with a liquid inlet end 115 and a liquid outlet end, and the liquid inlet end 115 is communicated with the storage box 204. The flexible separator is squeezed by inlet water of a washing machine flowing into/out of the water inlet cavity, and deformed to enable the laundry treatment agent accommodated in the liquid storage cavity to be discharged from the liquid outlet end.

According to the laundry treatment agent storage and dispensing device of the embodiment, the laundry treatment agent is stored in the storage device; the laundry treatment agent in the storage device is automatically dispensed by the dispensing device. The storage device and the dispensing device are integrally arranged. The liquid inlet end 115 can communicate with the storage cavity 203 by integrating a flow channel in the storage device, so that complicated pipeline communication between the dispensing device and the storage device is simplified, the structure is simpler, and assembly is more convenient due to the integrated design.

Further, the storage device comprises a storage housing internally provided with a storage cavity 203; the storage box 204 is arranged in the storage cavity 203 of the storage housing. The dispensing device is integrally arranged on the storage housing.

In order to realize communication of the liquid storage cavity of the dispensing device with the storage box 204 of the storage device, the storage housing is internally provided with a liquid outlet flow channel 206 communicated with the storage cavity 203. The liquid inlet end 115 of the dispensing device is communicated with the liquid outlet flow channel 206. According to the embodiment, the liquid outlet flow channel 206 communicated with the storage cavity 203 is designed by virtue of the internal cavity of the storage housing, then the dispensing device is integrally arranged on the storage housing. The dispensing device can be communicated with the storage device just by communicating the liquid inlet end with the liquid outlet flow channel 206, so that the pipeline connection is simplified, the structure is simple, and assembly is convenient.

Preferably, the storage housing is hollow internally, and a partition plate 209 is arranged in the storage housing to divide the storage housing into a storage cavity 203 and the liquid flow outlet channel 206 which are communicated with each other. The storage housing of the embodiment comprises a housing body 202 with an open cavity, and a housing cover body 201 which covers an opening of the housing body. The partition plate 209 is arranged on the housing cover body 201, extends towards a bottom wall of the housing body 202. An interval is formed between the bottom wall of the housing body 202 and the partition plate 209, so that the storage cavity 203 and the liquid outlet flow channel 206 can be communicated with each other. The liquid inlet end 115 of the dispensing device of the embodiment is arranged at a bottom of the housing body of the dispensing device and communicated with a top portion of the liquid outlet flow channel 206.

Further, the storage box 204 is installed in the storage cavity 203 of the storage housing in a drawable manner. The storage box 204 is provided with a storage liquid outlet end, and a one-way valve 208 is installed on the storage liquid outlet end. A column 207 is arranged in the liquid outlet flow channel 206, and one end of the column 207 extends into the storage cavity 203. When the storage box 204 is pushed into the storage cavity 203 of the storage housing, the one-way valve 208 is crashed to be open by the column 207, the storage box 204 communicates with the liquid outlet flow channel 206, and the laundry treatment agent in the storage box 204 flow into the liquid outlet flow channel 206.

The storage box 204 of the embodiment is a separate storage box and can be pulled out of/pushed into the storage housing independently. In this way, when the laundry treatment agent in the storage box is used up, the storage box 204 can be directly drawn out and replaced with a storage box full of laundry treatment agent. Or the storage box 204 is provided with a filling port 205, when the laundry treatment agent is used up, the storage box 204 can be drawn out and filled with laundry treatment agent through the filling port 205. Via the drawable design of the storage box 204 in the embodiment, replacement and feeding of the laundry treatment agent are facilitated.

As a preferred mode of the embodiment, the dispensing device comprises a housing internally provided with the hollow cavity, and the housing and the storage housing are integrally arranged.

Further, the housing comprises a first housing 109 and a second housing 114, the first housing 109 and/or the second housing 114 are/is internally provided with open grooves. The first housing 109 and the second housing 114 are connected in a sealed manner so as to seal the open grooves to form the hollow cavity. The edge of the flexible separator 110 is hermetically pressed between the first housing 109 and the second housing 114 to divide the hollow cavity into the water inlet cavity and the liquid storage cavity. The first housing 109 is provided with water inlet ends (101 and 105) and pressure relief ends (102 and 106) which are communicated with the water inlet cavity. The second housing 114 is provided with liquid inlet ends 115 and liquid outlet ends (103 and 107) which are communicated with the liquid storage cavity. The second housing 114 and the storage housing 201 are integrally arranged. The housing of the dispensing device of the embodiment comprises the first housing 109 and the second housing 114 which are detachably and fixedly connected.

The liquid inlet ends 115 and the liquid outlet ends (103 and 107) of the dispensing device of the embodiment are respectively provided with a one-way communicating device 1000 correspondingly. Inlet water of the washing machine squeezes the flexible separator to deform towards the liquid storage cavity; the one-way communicating devices in the liquid outlet ends (103 and 107) are opened to dispense the laundry treatment agents. The washing machine stops water inlet, the flexible separator is restored from deformation, and the one-way communicating devices in the liquid inlet ends 115 are opened to suck the laundry treatment agents in the storage box 204 into the liquid storage cavity.

As an implementation of the embodiment, the housing of the dispensing device is internally provided with at least two hollow cavities, the flexible separator 110 is installed in each of the hollow cavities in a sealed manner so as to divide each of the hollow cavities into the water inlet cavity and the liquid storage cavity.

The water inlet end and the pressure relief end which are communicated with the water inlet cavity are arranged at a part, corresponding to each of the hollow cavities, of the housing. The liquid inlet end and the liquid outlet end which are communicated with the liquid storage cavity are arranged at a part, corresponding to each of the hollow cavities, of the housing.

The storage housing of the storage device is internally provided with a plurality of storage boxes 204 corresponding to each of the hollow cavities of the dispensing device. Each of the storage boxes 204 is communicated with the liquid storage cavities of each of the hollow cavities.

The laundry treatment agent storage and dispensing device of the embodiment can store various laundry treatment agents, such as detergents, softeners, disinfectants and laundry care agents, and each of the laundry treatment agents can be dispensed by controlling inlet water of the washing machine to enter the corresponding hollow cavities of the dispensing device.

Specifically, when it is required to dispense the most commonly used detergent and softener, the housing is internally provided with a first hollow cavity and a second hollow cavity which are separated from each other. A first flexible separator is hermetically installed in the first hollow cavity to divide the first hollow cavity into a first water inlet cavity and a first liquid storage cavity. A second flexible separator is hermetically installed in the second hollow cavity to divide the second hollow cavity into a second water inlet cavity and a second liquid storage cavity.

The storage housing of the storage device is internally provided with a first storage cavity and a second storage cavity. The first storage cavity is internally provided with a first storage box, and the second storage cavity is internally provided with a second storage box. The first storage box is configured to be accommodating detergent; the second storage box is configured to be accommodating softener.

The storage housing is further internally provided with a first liquid outlet flow channel communicated with the first storage cavity, and a second liquid outlet flow channel communicated with the second storage cavity. The first liquid storage cavity is communicated with the first storage box via the first liquid outlet flow channel, and the second liquid storage cavity is communicated with the second storage box via the second liquid outlet flow channel.

In the embodiment, filling ports 205 are arranged at one ends of the storage boxes, the partition plate is arranged at another ends, opposite to the filling ports of the storage boxes, of the housing cover body 201. The second housing 114 of the dispensing device is integrally formed by the end, opposite to the filling ports, of the housing body.

Embodiment 3

As shown in FIGS. 1 to 7, the dispensing device of the embodiment comprises a housing, the housing is internally provided with at least two hollow cavities, a flexible separator 110 is hermetically installed in each of the hollow cavities to divide each of the hollow cavities into a water inlet cavity and a liquid storage cavity. The water inlet end and the pressure relief end which are communicated with the water inlet cavity are arranged at a part, corresponding to each of the hollow cavities, of the housing. The water inlet ends are communicated with a water inlet pipe of the washing machine. The liquid outlet ends communicated with the liquid storage cavities are arranged at the parts, corresponding to each of the hollow cavities, of the housing. The liquid storage cavities are configured to be accommodating laundry treatment agents. Inlet water of the washing machine enters the water inlet cavities through the water inlet end and squeezes the flexible separators 110 to deform towards the liquid storage cavities to enable the laundry treatment agents accommodated in the liquid storage cavities to be discharged from liquid outlet ends.

The dispensing device of the embodiment adopts a principle different from an existing automatic dispensing principle. Inlet water of the washing machine is used to squeeze the flexible separators 110 to deform towards the liquid storage cavities, and thereby the laundry treatment agents in the liquid storage cavities are "ejected", so that automatic dispensing of the laundry treatment agents is realized. The dispensing device of the embodiment can dispense agents just by controlling inlet water of the washing machine, the automatic dispensing principle is changed, the structural design is more optimized, and the production cost is lower.

Furthermore, the amount of the laundry treatment agents accommodated in the liquid storage cavities of the hollow cavities is fixed, all the laundry treatment agents are "ejected" each time, thus, the volume of the hollow cavities can be designed according to the demand for the laundry treatment agents or the dispensing number of times can be controlled. The dispensing amount of the laundry treatment agents is more accurate, and the laundry washing effect is improved.

In addition, the laundry treatment agents of the embodiment include but are not limited to detergents, softeners, disinfectants, laundry care agents and fragrances. The dispensing amount and dispensing time of various laundry treatment agents are different. The dispensing device of the embodiment can be provided with multiple hollow cavities for accommodating different laundry treatment agents; different kinds of laundry treatment agents are stored in the liquid storage cavities of each of the hollow cavities. The inlet water is controlled to enter the corresponding hollow cavities at the corresponding time to meet the dispensing requirements for the various laundry treatment agents. Therefore, the dispensing device of the embodiment can ensure that there are no residues in the process of dispensing the various different detergents and care agents, the problem of mutual contamination of different detergents and care agents will not occur, and the laundry washing effect is effectively improved.

In order to input the multiple laundry treatment agents, the dispensing device of the embodiment is internally provided with a plurality of hollow cavities separated from each other. As an implementation of the embodiment, the housing comprises a first housing 109 and a second housing 114, the first housing 109 and/or the second housing 114 are/is internally provided with open grooves, and the first housing 109 and the second housing 114 are connected in a sealed manner so as to seal the open grooves to form a plurality of hollow cavities separated from each other. The liquid storage cavities of each of the hollow cavities can accommodate different kinds of laundry treatment agents.

Further, the first housing 109 of the embodiment is internally provided with a plurality of first open grooves spaced apart from each other. The second housing 114 is internally provided with a plurality of second open grooves spaced apart from each other. The second open grooves correspond to the first open grooves in a one-to-one mode. The first housing 109 and the second housing 114 are connected in a sealed manner, open ends of the first open grooves and open ends of the second open grooves are butted into the hollow cavities in a sealed manner. The edges of the flexible separators 110 are hermetically pressed between the open ends of the first open grooves and the open ends of the second open grooves to divide each of the hollow cavities into water inlet cavities and liquid storage cavities. The housing of the embodiment is formed by hermetically connecting two parts, and the edges of flexible deformable surfaces of the flexible separators 110 are hermetically pressed at the joint of the first housing 109 and the second housing 114. In this way, while the first housing 109 and the second housing 114 are combined and installed, the flexible separators 110 are hermetically installed, assembly is simpler, and the hollow cavities are separated from each other due to hermetical connection of the first housing 109 and the second housing 114.

In the embodiment, the first housing 109 and the second housing 114 are fixedly connected by connectors. The connectors are connecting screws or connecting bolts. The first housing 109 is provided with installation holes, the second housing 114 is provided with holes correspondingly, and the connecting screws or connecting bolts penetrate through the installation holes and are fixedly connected with the second housing 114. Further, in order to separate the hollow cavities from each other, the housing of the embodiment is also provided with installation holes between the hollow cavities correspondingly.

It can be understood that the first housing 109 and the second housing 114 may also be connected in various implementations such as ultrasonic welding, hot melt welding, glue bonding and snap connection.

The automatic dispensing of the dispensing device of the embodiment is mainly realized by compressing the liquid storage cavities by means of the deformation of the flexible separator 110. Therefore, the flexible separators 110 are made of flexible and easily-deformable materials, such as rubber and plastic. Specifically, the flexible separators 110 described in the embodiment comprise flexible deformable surfaces, and edges of the flexible deformable surfaces are hermetically installed in the housing to divide the hollow cavities into the water inlet cavities and the liquid storage cavities. The water inlet ends face the flexible deformable surfaces. Inlet water of the washing machine enters from the water inlet ends and squeezes the flexible deformable surfaces to deform to enable the laundry treatment agents to be discharged from the liquid outlet ends. In the embodiment, the flexible deformable surfaces of the flexible separators 110 partition plate the interior of the housing into two sealed and independent containing cavities. Meanwhile, the flexible deformable surfaces are directly opposite to the water inlet ends, inlet water can directly impact the flexible deformable surfaces, the flexible deformable surfaces is deformed towards the liquid storage cavities to squeeze the laundry treatment agent to be discharged. The edges of the flexible deformable surfaces are hermetically fixed, and middles of the flexible deformable surfaces are deformable, and the sealed installation is simple and reliable.

Specifically, the flexible separator 110 of the embodiment is of a sack-like structure, and the sack-like structure extends towards the first housing 109 to form storage tanks. The sack-like structure is provided with corrugated structures, and thus has a better deformation effect.

In order to independently and automatically dispense the laundry treatment agents in each of the hollow cavities, the parts, corresponding to each of the hollow cavities, of the housing of the embodiment are provided with liquid inlet ends communicated with the liquid storage cavities. Each of the liquid inlet ends is communicated with each of the storage cavities 203 configured to be storing various laundry treatment agents. The liquid inlet ends and the liquid outlet ends are respectively provided with a one-way communicating device. Inlet water of the washing machine squeezes the flexible separators 110 to deform towards the liquid storage cavities; the one-way communicating devices in the liquid outlet ends are opened to dispense the laundry treatment agents. The washing machine stops water inlet, the flexible separators 110 restore from deformation, and the one-way communicating devices in the liquid inlet ends are opened to suck the laundry treatment agents in the storage cavities 203 into the liquid storage cavities. The volume of the hollow cavities of the dispensing device of the embodiment is fixed, and the volume of the liquid storage cavities partitioned by the flexible separators 110 is also fixed. In this way, the fixed amount of laundry treatment agents stored in the liquid storage cavities is all dispensed every time, the laundry treatment agents can be dispensed in multiple times by controlling water inlet until the required amount of the laundry treatment agents is dispensed.

As an implementation of the embodiment, space between the flexible separator 110 in the hollow cavity and the first housing 109 is the water inlet cavity, and space between the flexible separator 110 and the second housing 114 is the liquid storage cavities. The water inlet end and the pressure relief end are arranged on the first housing 109 and communicated with the water inlet cavity, and the liquid inlet end and the liquid outlet end are arranged on the second housing 114 and communicated with the liquid storage cavity.

The flexible separator 110 of the embodiment is flexible-material supports and has the functions of elastic deformation and restoration, but whether the flexible separators 110 restore normally is a premise for whether the dispensing device can accurately and effectively dispense the agents. Therefore, the dispensing device further comprises elastic restoration devices 111 arranged in each of the hollow cavities in the housing, elastic telescopic ends of the elastic restoration devices 111 abut against the flexible separators 110. The elastic restoration devices 111 are stressed during water inlet of the washing machine and deformed with the flexible separators 110 and drive the flexible separators 110 to restore from deformation when the washing machine stops water inlet.

Preferably, the elastic restoration devices 111 are springs.

Further, the flexible separator 110 is further provided with a reinforcement structure, and the reinforcement structure is located on surface, making contact with the elastic restoration device 111, of the flexible separator 110 for enhancing the stress strength of the flexible separator.

Preferably, the reinforcement structure is reinforcement plate, an installation hole is provided in a center of the reinforcement plate, an installation post is arranged on the surface, making contact with the elastic restoration device 111, of the flexible separator 110. The installation hole and the installation post are mounted together, and two ends of the elastic restoration device 111 are limitedly installed on the reinforcement plate and an inner wall of the hollow cavity correspondingly.

Preferably, the inner wall of the hollow cavity of the embodiment is provided with a limiting convex column, and the two ends of the elastic restoration device 111 are limitedly installed on the reinforcement plate and the limiting convex column. In this way, the two ends of the elastic restoration device 111 are limitedly installed so that elastic restoration of the flexible separator 110 can be ensured.

As an implementation of the embodiment, the housing of the dispensing device is internally provided with a first hollow cavity and a second hollow cavity which are spaced from each other. A first flexible separator is hermetically installed in the first hollow cavity and divides the first hollow cavity into a first water inlet cavity and a first liquid storage cavity. A second flexible separator is hermetically installed in the second hollow cavity and divides the second hollow cavity into a second water inlet cavity and a second liquid storage cavity. The first liquid storage cavity is configured to be accommodating detergent, and the second liquid storage cavity is configured to be accommodating softener. The parts, corresponding to the first hollow cavity, of the housing are provided with a first water inlet end 101 and a first pressure relief end 102 which are communicated with the first water inlet cavity, and also provided with a first liquid outlet end 103 and a first liquid inlet end which are communicated with the first liquid storage cavity. The parts, corresponding to the second hollow cavity, of the housing are provided with a second water inlet end 105 and a second pressure relief end 106 which are communicated with the second water inlet cavity, and also provided with a second liquid outlet end 107 and a second liquid inlet end which are communicated with the second liquid storage cavity.

The dispensing device of the embodiment can dispense the detergents and the softeners by means of inlet water. By controlling the number of times of water inlet and the timing of water inlet, the requirements on the dispensing amount and dispensing timing of the detergents and softeners can be met. Therefore, the dispensing device is simple in structure and accurate in input.

It should be noted that in the initial state of the dispensing device of the embodiment, the one-way communicating devices on the liquid inlet ends and the liquid outlet ends remain closed. During initial use, the liquid storage cavities are filled with air, therefore, the washing machine controls to discharge the air in the liquid storage cavities during first water inlet from the water inlet ends. The washing machine controls to stop water inlet from the water inlet ends, the flexible separators 110 restore, and the laundry treatment agents in the storage cavities are sucked into the liquid storage cavities. When the washing machine controls to inlet water again from the water inlet ends, the flexible separators 110 are squeezed to deform towards the liquid storage cavities, and the laundry treatment agents are "ejected", so that automatic input is achieved.

Embodiment 4

Figure 7:
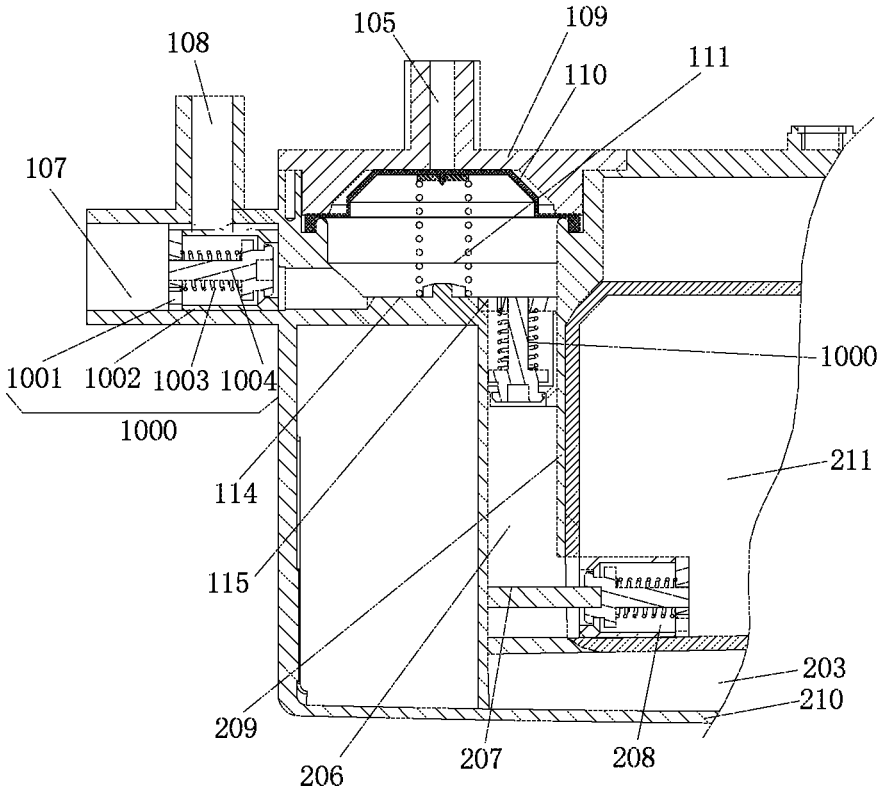
FIG. 7 is a partial enlarged view of FIG. 3 of a laundry treatment agent storage and dispensing device according to Embodiments 2 to 5 of the present disclosure.

On the basis of Embodiment 1, the dispensing device of the embodiment is further provided with one-way communicating devices applicable to liquid outlet ends and liquid inlet ends, specifically:

As shown in FIG. 3 or FIG. 7, each of the one-way communicating devices 1000 according to the embodiment comprises a valve body 1002, a valve cover 1001, a valve element 1004 and a spring 1003. Each of valve bodies 1002 is internally provided with a hollow channel. Each of valve covers 1001 is arranged at one end of the hollow channel of the corresponding valve body 1002, and a valve port is provided in each of the valve covers 1001. Each of the valve elements 1004 is arranged in the hollow channel of the corresponding valve body 1002, one end of each of the valve elements 1004 is movably installed in the corresponding valve port. Another end of each of the valve elements 1004 is matched with a channel opening of the hollow channel. One end of each of the springs 1003 abuts against the corresponding valve covers 1001, and another end of each of the springs 1003 abuts against the corresponding valve element 1004.

Specifically, the liquid outlet end of the embodiment is a liquid outlet pipe, the liquid outlet pipe is provided with a liquid outlet one-way communicating device. The liquid outlet one-way communicating device comprises a valve body, a valve cover, a valve element and a spring. A hollow channel is formed in the valve body. One end of the hollow channel of the valve body is communicated with the liquid storage cavity. Another end, away from the liquid storage cavity, of the hollow channel in the valve body is provided with the valve cover. A valve port is provided in the valve cover. One end of the valve element is movably installed on the valve cover, and another end of the valve element is matched with an end, communicated with the liquid storage cavity, of the hollow channel in the valve body. One end of the spring abuts against the valve cover, and another end of the spring abuts against the valve element.

The washing machine controls water to inlet through the water inlet end, inlet water squeezes the flexible separator to deform towards the liquid storage cavity. The volume of the liquid storage cavity decreases, the internal pressure of the liquid storage cavities increases, and the valve element is pushed up. The valve element no longer blocks the hollow channel in the valve body, and the liquid outlet one-way communicating device is opened, and the laundry treatment agent is discharged through the liquid outlet pipe, then the laundry treatment agent is dispensed.

In the embodiment, the liquid inlet end is a liquid inlet, the liquid inlet is communicated with the liquid outlet flow channel, and the liquid inlet is provided with a liquid inlet one-way communicating device. The liquid inlet one-way flow-through device comprises a valve body, a valve cover, a valve element and a spring. A hollow channel is formed in the valve body. One end of the hollow channel of the valve body is communicated with the liquid outlet flow channel, and another end of the hollow channel of the valve body is communicated with the liquid inlet. An end, connected to the liquid inlet, of the hollow channel in the valve body is provided with the valve cover. The valve cover is provided a valve port. One end of the valve element is movably installed in the valve cover, and another end of the valve element is matched with an end, connected to the liquid outlet flow channel, of the hollow channel in the valve body. One end of the spring abuts against the valve cover, and another end of the spring abuts against the corresponding valve element.

The washing machine controls water to inlet through the water inlet end, inlet water squeezes the flexible separator to deform towards the liquid storage cavity. The volume of the liquid storage cavities decreases, the internal pressure of the liquid storage cavities increases, the valve element is pushed to maintain sealed contact with the hollow channel in the valve body, and the liquid inlet one-way communicating device remain closed. The washing machine stops water inlet from the water inlet end, the flexible separator is squeezed to be restored from deformation, the volume of the liquid storage cavity is increased, the internal pressure is reduced, the pressure in the storage cavity pushes the valve element, and the valve element no longer blocks the hollow channel in the valve body, the liquid inlet one-way communicating device is opened, and the laundry treatment agent enters the liquid storage cavity through the liquid outlet flow channel from the storage cavity.

Further, in order to improve the sealing performance of the liquid outlet one-way communicating device and the liquid inlet one-way communicating device, sealing rings are installed on a sealing ends of the valve elements.

Embodiment 5

As shown in FIGS. 1-7, a dispensing device of the embodiment comprises a housing internally provided with a hollow cavity; a flexible separator 110 is hermetically installed in the hollow cavity to divide the containing cavity into a water inlet cavity and a liquid storage cavity. The housing is provided with a water inlet end and a pressure relief end which communicate with the water inlet cavity, and the water inlet end communicates with a water inlet pipe of the washing machine; the housing is provided with a liquid outlet end communicating with the liquid storage cavity, and laundry treatment agents are accommodated in the liquid storage cavity; and the liquid outlet end is provided with a flushing end communicating with the liquid outlet end.

Inlet water of a washing machine enters the water inlet cavity from the water inlet end, squeezes the flexible separator 110 to deform towards the liquid storage cavity, the volume of the liquid storage cavity decreases, the laundry treatment agents are discharged from the liquid outlet end, and flushing water flow enters the liquid outlet end from the flushing end to flush the laundry treatment agents.

The liquid outlet end of the dispensing device of the embodiment is provided with the flushing end communicating with the liquid outlet end. By introducing the flushing water flow from the flushing end into the liquid outlet end to flush the laundry treatment agents, dispensing of the laundry treatment agents is facilitated, there is no residue, and waste is avoided while accurate dispensing amount is ensured.

Flushing water flow of the embodiment may be introduced separately, for example, a branch of a washing machine water inlet pipe may communicate with the flushing end, and the laundry treatment agents may be flushed by controlling inlet water to enter the flushing end.

As a preferred implementation of the embodiment, according to the working characteristics of the dispensing device, inlet water needs to be controlled to enter the water inlet cavity of the hollow cavity and flows out from the pressure relief end, and thus the water flowing out from the pressure relief end is used for flushing the laundry treatment agents. Specifically, the pressure relief end described in the embodiment communicates with the flushing end, inlet water of the washing machine enters the water inlet cavity from the water inlet end, flows out from the pressure relief end, and enters the liquid outlet end through the flushing end to flush the laundry treatment agent. In this embodiment, by connecting the pressure relief end and the flushing end, the water inlet of the washing machine not only realizes the dispensing of the laundry treatment agents, but also can be used for flushing the laundry treatment agents.

Further, the pressure relief end and the liquid outlet end which are arranged on the same hollow cavity communicate with each other As an implementation of the embodiment, the housing is internally provided with a first hollow cavity and a second hollow cavity which are spaced from each other, a first flexible separator is hermetically installed in the first hollow cavity and divides the first hollow cavity into a first water inlet cavity and a first liquid storage cavity, and a second flexible separator is hermetically installed in the second hollow cavity and divides the second hollow cavity into a second water inlet cavity and a second liquid storage cavity, detergents are accommodated in the first liquid storage cavity, and softeners are accommodated in the second liquid storage cavity.

The parts, corresponding to the first hollow cavity, of the housing are provided with a first water inlet end 101 and a first pressure relief end 102 which communicate with the first water inlet cavity, and also provided with a first liquid outlet end 103 communicating with the first liquid storage cavity. The parts, corresponding to the second hollow cavity, of the housing are provided with a second water inlet end 105 and a second pressure relief end 106 which communicate with the second water inlet cavity, and also provided with a second liquid outlet end 107 communicating with the second liquid storage cavity; a first flushing end 104 is arranged on the first liquid outlet end 103, the first flushing end 104 communicates with the first pressure relief end 102, a second flushing end 108 is arranged on the second liquid outlet end 107, and the second flushing end 108 communicates with the second pressure relief end 106.

Embodiment 6

The embodiment provides a washing machine including the laundry treatment agent storage and dispensing device as described in Embodiments 1-4, the washing machine comprises a water inlet valve and a water collection box. The water inlet valve comprises a first water outlet control end communicating with the water collection box, and a second water outlet control end communicating with a water inlet cavity of the dispensing device; and all pressure relief ends and all liquid outlet ends of the dispensing device communicate with the water collection box.

According to a control method of the washing machine in the embodiment, when a certain laundry treatment agent needs to be dispensing, washing water is controlled by the washing machine to enter the water inlet end corresponding to the laundry treatment agent from the second water outlet control end of the water inlet valve, squeezes flexible separators to deform towards a liquid storage cavity, the volume of the liquid storage cavity decreases, and the laundry treatment agent is discharged from the corresponding liquid outlet end into the water collection box, is mixed with washing water discharged from the pressure relief ends and then flows into a washing tub of the washing machine.

Embodiment 7

A washing machine of the embodiment comprises a storage device for storing laundry treatment agents and a dispensing device for dispensing the laundry treatment agents, the dispensing device is provided with a hollow cavity, and a separator is hermetically installed in the hollow cavity to divide the hollow cavity into a water inlet cavity and a liquid storage cavity, the water inlet cavity is provided with a water inlet end and a pressure relief end, the water inlet end communicates with a water inlet control device of the washing machine, the liquid storage cavity is provided with a liquid inlet end and a liquid outlet end, and the liquid inlet end communicates with the storage device.

When the water inlet control device is on, washing water enters the water inlet cavity of the dispensing device from the water inlet end and flows out from the pressure relief end, the washing water drives the separator to move towards the liquid storage cavity or squeezes the separator to deform towards the liquid storage cavity, the laundry treatment agents in the liquid storage cavity are discharged from the liquid outlet end, and thus dispensing of the laundry treatment agents is realized.

When the water inlet control device is off, washing water stops entering the dispensing device, and the separator returns to the original parts or is restored to suck the laundry treatment agents in the storage device into the liquid storage cavity of the dispensing device for next dispensing.

In the embodiment, the separator can be movably arranged in the hollow cavity. The separator divides the hollow cavity into a water inlet cavity and a liquid storage cavity. During water inlet, the water pressure pushes the separator to move towards the liquid storage cavity for releasing the laundry treatment agents in the liquid storage cavity. The separator in the embodiment may also be a flexible separator which is fixedly arranged in the hollow cavity and is flexibly deformable, during water inlet; the water pressure presses the flexible separator to deform towards the liquid storage cavity for releasing the laundry treatment agents in the liquid storage cavity. Preferably, a flexible separator is adopted in the embodiment, sealed and fixed connection is facilitated, and the dispensing effectiveness is ensured.

The agent dispensing device of the embodiment adopts a principle different from an existing automatic dispensing principle, inlet water of the washing machine is used for squeezing the flexible separator to displace or deform towards the liquid storage cavity, and then the laundry treatment agents in the liquid storage cavity are "ejected", so that automatic dispensing of the laundry treatment agents is realized. The dispensing device of the embodiment can dispense agents just by controlling inlet water of the washing machine, the automatic dispensing principle is changed, the structural design is more optimized, and the production cost is lower.

Furthermore, the amount of the laundry treatment agents accommodated in the liquid storage cavity of the hollow cavity is fixed, all the laundry treatment agents are "ejected" each time, thus, the volume of the hollow cavity can be designed or the dispensing number of times can be controlled according to the demand for the laundry treatment agents, the dispensing amount of the laundry treatment agents is more accurate, and the laundry washing effect is improved.

When the washing machine performs laundry washing, different laundry washing procedures and different amounts of laundry require different amounts of laundry treatment agents. Therefore, in the specific laundry washing process, the dispensing number of times of the dispensing device needs to be determined according to the required dispensing amount of the laundry treatment agents during each time of washing.

However, in the embodiment, the dispensing amount of the laundry treatment agents is obtained by multiplying the dispensing number of times by the single dispensing amount, therefore, it is known that whether the single dispensing amount is accurate is the key to the accurate dispensing of the laundry treatment agents, and the single dispensing amount is determined by the water inlet velocity of inlet water, when the water inlet velocity is greater than or equal to a set value, the single complete dispensing of the laundry treatment agents can be realized, while when the water inlet velocity is smaller than the set value, the single complete dispensing of the laundry treatment agents cannot be realized, and then the accuracy of the total dispensing amount of the laundry treatment agents is affected.

Therefore, in the embodiment, a laundry treatment agent dispensing control method of the washing machine comprising: determining, by the washing machine, the dispensing number of times N of the dispensing device according to the total dispensing amount M of laundry treatment agents, the single quantitative dispensing amount m of the dispensing device, and the water inlet velocity V of inlet water of the washing machine; and controlling the opening-closing number of times of a water inlet control device according to the dispensing number of times.

The influence of the water inlet velocity on the single dispensing amount is fully considered according to the dispensing principle of the dispensing device in the embodiment, and the dispensing accuracy of the laundry treatment agents is improved.

Further, according to the laundry treatment agent dispensing control method of the washing machine in the embodiment, when the water inlet velocity V is greater than or equal to V0, the single quantitative dispensing amount m of the dispensing device is equal to m0, wherein m0 is the dispensing amount of the laundry treatment agents by the dispensing device during single complete dispensing, and the dispensing number of times N0=M/m0.

When the water inlet velocity V is smaller than V0, the single quantitative dispensing amount of the dispensing device m=A+B*V, wherein A and B are correction coefficients, then the dispensing number of times N'=M/(A+B*V); and V0 is the minimum water inlet velocity value for the dispensing device to realize single complete dispensing of the laundry treatment agents.

Figure 8:
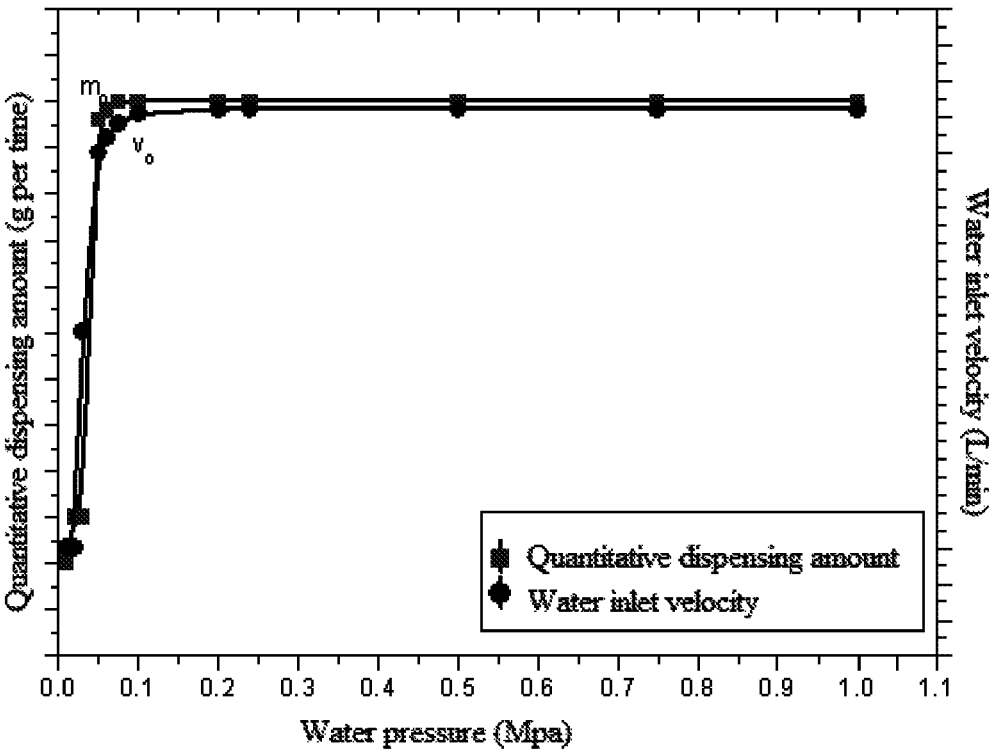
FIG. 8 is a relation curve between single dispensing amount, water pressure and water inlet velocity of a dispensing device according to Embodiment 7 of the present disclosure.

As shown in FIG. 8, the relation curve between the water inlet velocity and the water pressure shows that the water pressure determines the water inlet velocity. Therefore, according to the laundry treatment agent dispensing control method of the washing machine in the embodiment, when the water inlet pressure P is higher than a set value P0, the water inlet velocity V is greater than or equal to V0. When the water inlet pressure P is lower than the set value P0, the water inlet velocity V is smaller than V0, wherein P0 is the minimum water pressure value for reaching the water inlet velocity V0.

Preferably, P0 ranges from 0.05 MPa to 0.1 MPa; further preferably, P0=0.05 MPa.

Specifically, according to the laundry treatment agent dispensing control method of the washing machine in the embodiment, the washing machine starts a washing procedure, weighs laundry to determine the total dispensing amount M of required laundry treatment agents, and calculates the initial dispensing number of times N0=M/m0; the washing machine starts to inlet water, detects and determines the water inlet velocity V, when V is greater than or equal to V0, the washing machine controls to complete N0 times of laundry treatment agent dispensing, when V is smaller than V0, then the washing machine corrects the dispensing number of times N'=M/(A+B*V), and the washing machine controls to dispense the agents according to the corrected number of times.

As a preferred implementation of the embodiment, the water inlet velocity V of the washing machine is calculated by a water level detection device and a passage of the water inlet control device by timing.

Or, a flow sensor for measuring the water inlet velocity V is arranged on a water inlet pipe of the washing machine.

Specifically, the water inlet control device described in the embodiment is a water inlet solenoid valve. The single dispersion of the laundry treatment agents can be completed by the washing machine through controlling the water inlet solenoid valve to be opened from a closed state, and the washing machine controls the water inlet solenoid valve to be closed-opened for N times according to the calculated dispensing number of times N.

Further, according to the laundry treatment agent dispensing control method of the washing machine in the embodiment, after the washing machine controls the water inlet solenoid valve to be closed-opened for (N−1) times during the water inlet process, the washing machine controls the water inlet solenoid valve to be opened for the Nth time and to remain opened until the inlet water reaches a set water level, and then water inlet solenoid valve is closed.

According to the laundry treatment agent dispensing control method of the washing machine in the embodiment, the dispensing device at least comprises a first dispensing device for dispensing detergents and a second dispensing device for dispensing softeners, the storage device at least comprises a first storage device for storing the detergents and a second storage device for storing the softeners, and the water inlet control device comprises a first water inlet control device for feeding water into the first dispensing device and a second water inlet control device for feeding water into the second dispensing device.

During the water inlet process of the washing procedure, the washing machine determines the dispensing number of times of the detergents, and controls the first water inlet control device to be closed-opened for corresponding times; and during the water inlet process of the last rinsing procedure, the washing machine determines the dispensing number of times of the softeners, and the controls the second water inlet control device to be closed-opened for corresponding times.

In the embodiment, dispensing of the detergents and the softeners can be realized, and the dispensing amounts of the detergents and the softeners can be corrected, so that the dispensing accuracy of the detergents and the softeners is improved.

Further, the water inlet velocity V is obtained during the water inlet process of the washing procedure of the washing machine, and is used to calculate the dispensing number of times of the softeners during the water inlet process of the rinsing procedure.

Figure 9:
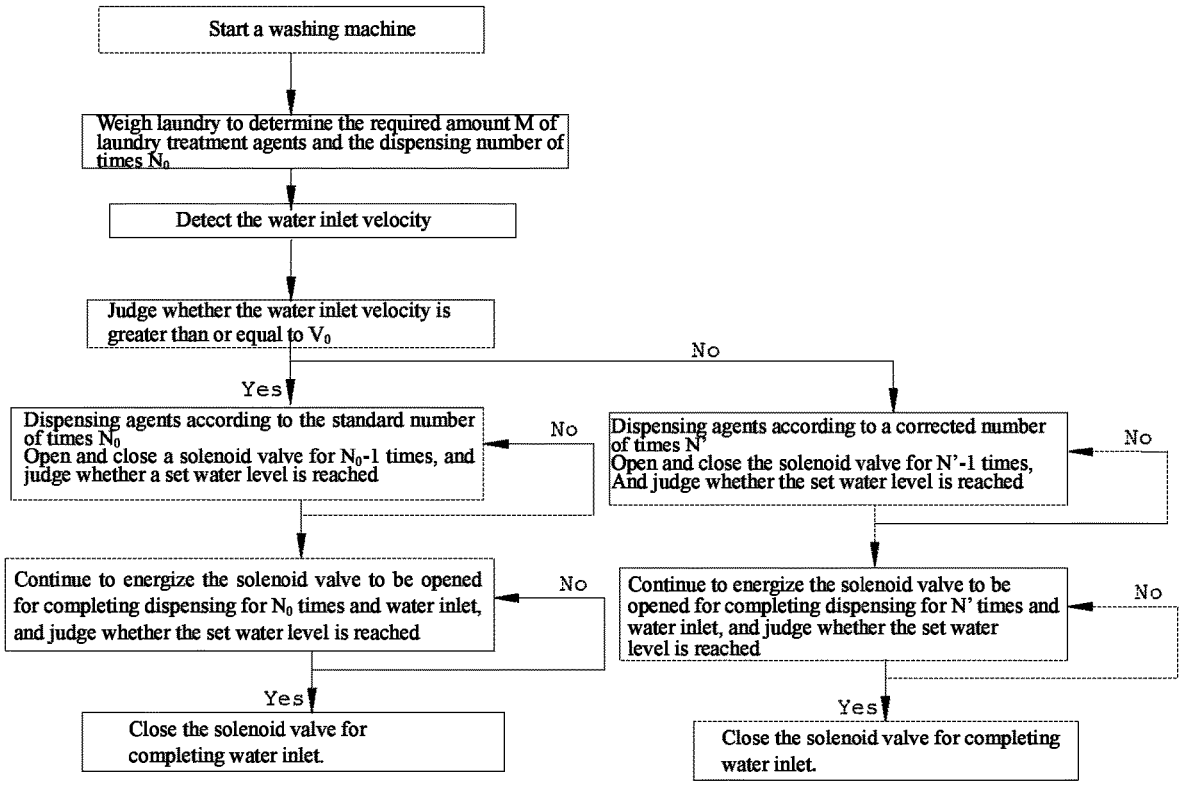
FIG. 9 is a flowchart of a laundry treatment agent dispensing control method of a washing machine according to Embodiment 7 of the present disclosure.

As shown in FIG. 9, the laundry treatment agent dispensing control method of the washing machine in the embodiment comprising:

S1, starting the washing machine;

S2, weighing, by the washing machine, laundry to determine the required amount M of laundry treatment agents, and calculating the initial dispensing number of times N0=M/m0;

S3, obtaining, by the washing machine, the water inlet velocity V and judging whether the water inlet velocity V is greater than or equal to V0; and S4, if yes, controlling the water inlet control device to open and close for (N0−1) times, and keeping the water inlet control device being opened when the water inlet control device has closed and opened for the N0th time until inlet water reaches a set water level, and then closing the water inlet control device;

if no, correcting the dispensing number of times N' to be equal to M/(A+B*V) controlling the water inlet control device to open and close for (N'−1) times, keeping the water inlet control device being opened when the water inlet control device has closed and opened for the N'th time until inlet water reaches a set water level, and then closing the water inlet control device.

Embodiment 8

A washing machine comprises a storage device for storing laundry treatment agents and a dispensing device for dispensing the laundry treatment agents, the dispensing device is provided with a hollow cavity, a separator is hermetically installed in the hollow cavity to divide the hollow cavity into a water inlet cavity and a liquid storage cavity, the water inlet cavity is provided with a water inlet end and a pressure relief end, the water inlet end communicates with a water inlet control device of the washing machine, the liquid storage cavity is provided with a liquid inlet end and a liquid outlet end, and the liquid inlet end communicates with the storage device.

After the water inlet control device is opened, washing water enters the water inlet cavity of the dispensing device, drives the separator to move towards the liquid storage cavity or squeezes the separator to deform towards the liquid storage cavity to enable the laundry treatment agents in the liquid storage cavity to be discharged from the liquid outlet end.

After the water inlet control device is closed, washing water stops entering the dispensing device, and the separator returns to the original position or is restored to suck the laundry treatment agents in the storage device into the liquid storage cavity of the dispensing device.

In the embodiment, the separator can be movably arranged in the hollow cavity. The separator divides the hollow cavity into the water inlet cavity and the liquid storage cavity. During water inlet, the water pressure pushes the separator to move towards the liquid storage cavity for releasing the laundry treatment agents in the liquid storage cavity. The separator in the embodiment may also be a flexible separator which is fixedly arranged in the hollow cavity and is flexibly deformable, during water inlet; the water pressure presses the flexible separator to deform towards the liquid storage cavity for releasing the laundry treatment agents in the liquid storage cavity. Preferably, a flexible separator is adopted in the embodiment, sealed and fixed connection is facilitated, and the dispensing effectiveness is ensured.

The dispensing device of the embodiment adopts a principle different from an existing automatic dispensing principle, inlet water of the washing machine is used for squeezing the flexible separator to displace or deform towards the liquid storage cavity for "ejecting" the laundry treatment agents in the liquid storage cavity, so that the automatic dispensing of the laundry treatment agents is realized. The dispensing device of the embodiment can dispense agents just by controlling inlet water of the washing machine, the automatic dispensing principle is changed, the structural design is more optimized, and the production cost is lower.

Furthermore, the amount of the laundry treatment agents accommodated in the liquid storage cavity of the hollow cavity is fixed, all the laundry treatment agents are "ejected" during each time of dispensing, thus, the volume of the hollow cavity can be designed or the dispensing number of times can be controlled according to the demand for the laundry treatment agents, the dispensing amount of the laundry treatment agents is more accurate, and the laundry washing effect is improved.

The process of dispensing laundry by the dispensing device of the embodiment generally comprises: the washing machine determines the total dispensing amount at first and determines the dispensing number of times N according to the total dispensing amount and each-time dispensing amount of the dispensing device, the washing machine controls the water inlet control device to be closed-opened for the dispensing device to carry out dispensing for the determined times, after performing the N−1th dispensing action, the water inlet control device remains opened at the Nth action until the set water level is reached, and accurate dispensing of the laundry treatment agents is achieved while water inlet is realized.

However, in a drum washing machine, the total water volume is low and laundry are water-absorbent, after inlet water reaches the preset water level and after the drum rotates and laundry absorbs water, the water level is judged, once the water level is lower than the preset water level, the water inlet control devices need to be opened to continue water refilling. For the dispensing mode, if the washing machine is refilled with water, the dispensing amount is high, and dispensing errors are caused.

Therefore, a laundry treatment agent automatic dispensing method of a washing machine in the embodiment comprises: the washing machine determines the dispensing number of times N of the dispensing device, and the washing machine controls the water inlet control device to be closed/opened for N times in total during the main water inlet process and after main inlet water reaches the set water level. That is, laundry treatment agents are not dispensing for N times during the main water inlet process, some of the laundry treatment agents remain for dispensing during the subsequent refilling process, or the laundry treatment agents can be rapidly dispensing for the returns to the original position times after the main water inlet process even if water refilling is not conducted, the water inlet volume slightly increases but is negligible, while accurate dispensing at the dispensing amount is achieved.

Further, according to the laundry treatment agent dispensing control method of the washing machine in the embodiment, after the washing machine completes the main water inlet process, if the water refilling process is performed, the water inlet control device is controlled to be closed/opened for N times in total during the main water inlet process, during the water refilling process and after the water refilling process.

Figure 10:
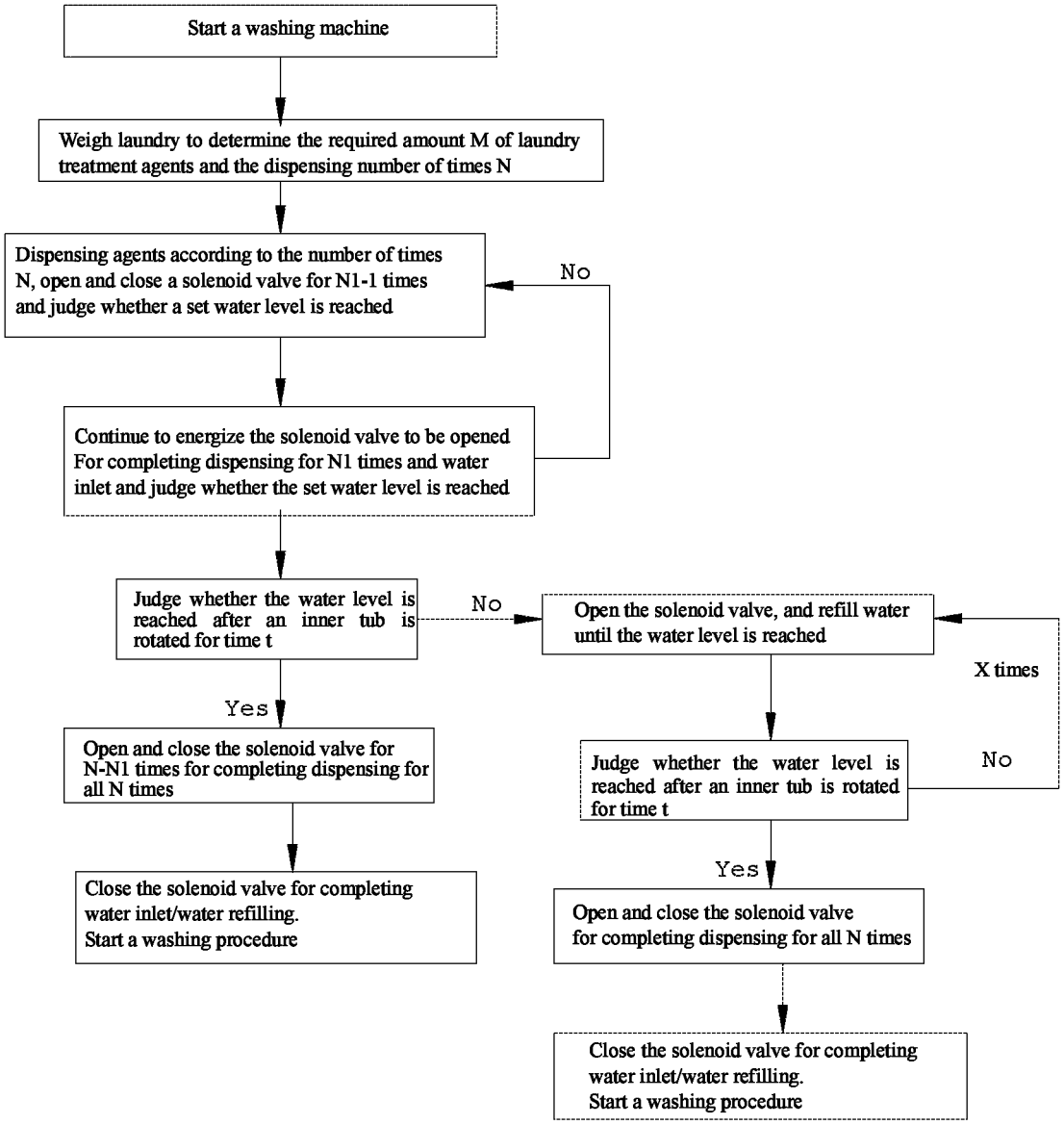
FIG. 10 is a flowchart of laundry treatment agent dispensing control method of a washing machine according to Embodiment 8 of the present disclosure.

Specifically, as shown in FIG. 10, according to the laundry treatment agent dispensing control method of the washing machine in the embodiment, if the washing machine performs the water refilling process, the water inlet control device is controlled to be closed/opened for N1 times during the main water inlet process, to be closed/opened for N2 times during the water refilling process and to be closed/opened for N3 times after the water refilling process is completed, wherein $N1+N2 \leq N$, and N2 is larger than or equal to the maximum times in the water refilling process of the washing machine.

According to the laundry treatment agent dispensing control method of the washing machine in the embodiment, water inlet of the washing machine comprises the main water inlet process, the washing machine controls the water inlet control devices to be closed/opened for N1 times during the main water inlet process, wherein $N>N1$, whether the water refilling process needs to be performed is judged after the main water inlet process is completed, if yes, the washing machine controls the water inlet control devices to be closed/opened for (N−N1) times during the water refilling process and after the water refilling process is completed; if no, the washing machine controls the water inlet control devices to be closed/opened for (N−N1) times.

Further, if the washing machine performs the water refilling process, the washing machine controls the water inlet control devices to be closed/opened for N2 times, $N2 \leq (N-N1)$, and after the water refilling process is completed, the washing machine controls the water inlet control devices to be closed/opened for (N−N1−N2) times.

Further, if the washing machine performs the water refilling process for x times, then the water inlet control device is controlled to be closed/opened for N21 times during the first water refilling process, to be closed/opened for N22 times during the second times . . . and to be closed/opened for N2x times during the xth water refilling process, wherein $N21+N22+ \ldots +N2x=N2$, and N21, N22, . . . , N2x are respectively greater than or equal to 1.

According to the laundry treatment agent dispensing control method of the washing machine in the embodiment, after the washing machine performs the main water inlet process and controls the water inlet control devices to be closed/opened for N1−1 times, the washing machine controls the water inlet control devices to be opened for the N1th time, remain opened and then be closed until inlet water reaches the set water level, and then the main water inlet process is completed.

Further, after the main water inlet process is completed and the washing machine controls an inner tub to rotate for a set time t, it is detected whether the water level reaches the set water level, if yes, the washing machine controls the water inlet control devices to be closed/opened for N−N1 times so as to complete dispensing of the laundry treatment agents, and if no, the washing machine performs the water refilling process.

As an implementation of the embodiment, the washing machine determines the dispensing number of times $N=M/m$ of the dispensing device according to the total dispensing amount M of the laundry treatment agents and the single quantitative dispensing amount m of the dispensing device, and controls the opening-closing number of times of the water inlet control devices according to the dispensing number of times.

As an implementation of the embodiment, the washing machine determines the dispensing number of times N of the dispensing device according to the total dispensing amount M of the laundry treatment agents, the single quantitative dispensing amount m of the dispensing device, and the water inlet velocity V of inlet water of the washing machine, and controls the opening-closing number of times of the water inlet control devices according to the dispensing number of times.

When the water inlet velocity V is greater than or equal to V0, the single quantitative dispensing amount m of the dispensing device is equal to m0, m0 is the dispensing amount of the laundry treatment agents by the dispensing device during single complete dispensing, and then the dispensing number of times N0=M/m0.

When the water inlet velocity V is lower than V0, the single quantitative dispensing amount m of the dispensing device is equal to A+B*V, wherein A and B are correction coefficients, and then the dispensing number of times N'=M/(A+B*V); and V0 is the minimum water inlet velocity value for the dispensing device to realize single complete dispensing of the laundry treatment agents.

When the washing machine performs laundry washing, different laundry washing procedures and different amounts of laundry require different amounts of laundry treatment agents. Therefore, in the specific laundry washing process, the dispensing number of times of the dispensing device needs to be determined according to the required dispensing amount of the laundry treatment agents during each time of washing.

However, the dispensing amount of the laundry treatment agents in the embodiment is obtained by multiplying the dispensing number of times by the single dispensing amount, therefore, it is known that whether the single dispensing amount is accurate is the key to the accurate dispensing of the laundry treatment agents, the single dispensing amount is determined by the water inlet velocity of inlet water, when the water inlet velocity is greater than or equal to a set value, single complete dispensing of the laundry treatment agents can be realized, while when the water inlet velocity is smaller than the set value, single complete dispensing of the laundry treatment agents cannot be realized, and then the accuracy of the total dispensing amount of the laundry treatment agents is affected.

The influence of the water inlet velocity on the single dispensing amount is fully considered according to the dispensing principle of the dispensing device in the embodiment, and the dispensing accuracy of the laundry treatment agents is improved.

It is necessary to supplement the description of the above embodiments 7 and 8 that the storage device and the dispensing device of the embodiments 7 and 8 may be arranged separately and communicate with each other through a pipeline.

The above embodiments of the present disclosure may be combined with each other into new technical solutions which are all within the scope claimed by the present disclosure.

The above descriptions are only preferred embodiments of the present disclosure, and are not intended to limit the present disclosure in any form. Although the present disclosure has been disclosed in the preferred embodiments as above, but the preferred embodiments are not intended to limit the present disclosure. Any person skilled in the art of the present disclosure can use the technical content suggested above to make some alterations or modifications to equivalent embodiments without departing from the scope of the technical solutions of the present disclosure. Any simple modifications, equivalent changes and modifications to the above embodiments based on the technical essence of the present disclosure still fall within the scope of the present disclosure.

The invention claimed is:

1. A laundry treatment agent storage and dispensing device, comprising:

a storage device and a dispensing device being integrally arranged; wherein the storage device includes a hollow storage housing internally provided with a storage cavity configured to store laundry treatment agent;

the dispensing device is provided with a hollow cavity, and a flexible separator is hermetically arranged in the hollow cavity and divides the hollow cavity into a water inlet cavity and a liquid storage cavity;

the liquid storage cavity has a liquid inlet end and a liquid outlet end, the liquid inlet end communicates with the storage cavity; and when inlet water of a washing machine flows into the water inlet cavity, the flexible separator is configured to be squeezed to deform towards the liquid storage cavity to enable the laundry treatment agent accommodated in the liquid storage cavity to be discharged through the liquid outlet end;

a filling port, communicates with the storage cavity, being provided on the storage housing, and the dispensing device is integrally arranged on the storage housing, a partition plate arranged in the storage housing, and an interior of the storage housing is divided by the partition plate into the storage cavity and a liquid outlet flow channel which communicate with each other; and the liquid inlet end of the dispensing device communicates with the liquid outlet flow channel.

2. The laundry treatment agent storage and dispensing device according to claim 1, wherein the dispensing device comprises a housing internally provided with the hollow cavity, the housing comprises a first housing and a second housing, at least one of the first housing and the second housing is internally provided with an open groove, and the first housing and the second housing are hermetically connected to seal the open groove to form the hollow cavity;

an edge of the flexible separator is hermetically pressed between the first housing and the second housing to divide the hollow cavity into the water inlet cavity and the liquid storage cavity;

a water inlet end and a pressure relief end which are communicated with the water inlet cavity are provided on the first housing, and the liquid inlet end and the liquid outlet end which are communicated with the liquid storage cavity are provided on the second housing; and the second housing and the storage housing are integrally arranged.

3. The laundry treatment agent storage and dispensing device according to claim 2, wherein the housing of the dispensing device is internally provided with at least two hollow cavities, and each hollow cavity comprises a respective flexible separator hermetically installed for dividing each of the hollow cavities into a water inlet cavity and a liquid storage cavity;

the water inlet end and the pressure relief end which communicate with the water inlet cavity are arranged at a part, corresponding to each of the hollow cavities, of the housing; and the liquid inlet end and the liquid outlet end which communicate with the liquid storage cavity are arranged at the part, corresponding to each of the hollow cavities, of the housing; and the storage housing of the storage device is internally provided with a plurality of storage cavities, each of the storage cavities of the storage device corresponds to respective hollow cavities of the dispensing device, and the storage housing of the storage device is provided with a plurality of filling ports communicated with each of the storage cavities, and each of the storage cavities is communicated with the liquid storage cavities of the hollow cavities correspondingly.

4. The laundry treatment agent storage and dispensing device according to claim 1, wherein the liquid inlet end and the liquid outlet end are respectively provided with a one-way communicating device:

the flexible separator is configured to be deformed towards the liquid storage cavity by inlet water of the washing machine, so the one-way communicating device in the liquid outlet end is opened to dispense laundry treatment agent, and the flexible separator is configured to be restored from deformation when the washing machine stops feeding water, so the one-way communicating device in the liquid inlet end is opened to suck the laundry treatment agent in the storage cavity into the liquid storage cavity.

5. The laundry treatment agent storage and dispersing device according to claim 1, wherein the storage cavity includes a storage box configured to store the laundry treatment agent and the liquid inlet end communicates with the storage box.

6. The laundry treatment agent storage and dispensing device according to claim 5, wherein the storage box is installed in the storage cavity of the storage housing in a drawable manner, the storage box is provided with a storage liquid outlet end, and a one-way valve is installed on the storage liquid outlet end;

a column is arranged in the liquid outlet flow channel, and one end of the column extends into the storage cavity; and when the storage box is pushed into the storage cavity of the storage housing, the one-way valve is configured to be opened by the column; the storage box is communicated with the liquid outlet flow channel, and the laundry treatment agents in the storage box flow into the liquid outlet flow channel.

* * * * *